US011193233B2

(12) United States Patent
Favaro et al.

(10) Patent No.: US 11,193,233 B2
(45) Date of Patent: Dec. 7, 2021

(54) LAUNDRY WASHING MACHINE COMPRISING A WATER SOFTENING DEVICE

(71) Applicant: Electrolux Appliances Aktiebolag, Stockholm (SE)

(72) Inventors: Daniele Favaro, Porcia PN (IT); Maurizio Del Pos, Porcia PN (IT); Giorgio Carrer, Collegno TO (IT); Enzo Brignone, Dronero CN (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 58 days.

(21) Appl. No.: 16/085,822

(22) PCT Filed: Mar. 24, 2016

(86) PCT No.: PCT/EP2016/056550
§ 371 (c)(1),
(2) Date: Sep. 17, 2018

(87) PCT Pub. No.: WO2017/162290
PCT Pub. Date: Sep. 28, 2017

(65) Prior Publication Data

US 2019/0048508 A1 Feb. 14, 2019

(51) Int. Cl.
*D06F 39/08* (2006.01)
*D06F 39/00* (2020.01)
(Continued)

(52) U.S. Cl.
CPC ..... *D06F 39/007* (2013.01); *D06F 34/22* (2020.02); *D06F 39/028* (2013.01);
(Continued)

(58) Field of Classification Search
CPC .. D06F 39/007; D06F 39/087; D06F 2103/18; D06F 2202/085; A47L 15/4229;
(Continued)

(56) References Cited

U.S. PATENT DOCUMENTS 2,434,353 A 1/1948 Edwards
2,472,665 A * 6/1949 Ladner ..... G01F 23/60 340/450.2
(Continued)

FOREIGN PATENT DOCUMENTS

CN 1552635 A 12/2004
CN 101029446 A 9/2007
(Continued)

OTHER PUBLICATIONS

DE10204002—Machine Translation (Year: 2003).*
(Continued)

*Primary Examiner* — Marc Lorenzi
(74) *Attorney, Agent, or Firm* — RatnerPrestia

(57) ABSTRACT

A laundry washing machine having an outer casing, a washing tub, a rotatable drum, a detergent dispenser, a fresh-water supply circuit, an internal water softening device filled with a water softening agent capable of reducing the hardness degree of the fresh water directed towards the detergent dispenser or the washing tub, a regeneration-agent reservoir located/recessed inside the outer casing and structured for being manually fillable with consumable salt or other regeneration agent, a first water-supply line for channeling fresh water into said regeneration-agent reservoir so as to form brine, a brine reservoir fluidically connected to said regeneration-agent reservoir for receiving and accumulating the brine arriving from said regeneration-agent reservoir, and a detector assembly for detecting when the salinity
(Continued)

degree of the brine stored into brine reservoir exceeds a predetermined minimum salinity value.

21 Claims, 11 Drawing Sheets

(51) Int. Cl.

| | |
|---|---|
| *D06F 103/00* | (2020.01) |
| *D06F 103/18* | (2020.01) |
| *D06F 103/20* | (2020.01) |
| *D06F 105/02* | (2020.01) |
| *D06F 105/58* | (2020.01) |
| *D06F 105/60* | (2020.01) |
| *D06F 34/22* | (2020.01) |
| *D06F 101/20* | (2020.01) |
| *D06F 39/02* | (2006.01) |

(52) U.S. Cl.
CPC ..... *D06F 39/087* (2013.01); *D06F 2101/20* (2020.02); *D06F 2103/00* (2020.02); *D06F 2103/18* (2020.02); *D06F 2103/20* (2020.02); *D06F 2105/02* (2020.02); *D06F 2105/58* (2020.02); *D06F 2105/60* (2020.02)

(58) Field of Classification Search
CPC ..... A47L 15/4231; A47L 15/0055; A47L 2301/023; A47L 2401/023; G01F 23/32; G01F 23/30–76
See application file for complete search history.

(56) References Cited

U.S. PATENT DOCUMENTS

| | | | | |
|---|---|---|---|---|
| 2,907,844 | A * | 10/1959 | Lindsey | G01F 23/60 200/84 R |
| 4,710,853 | A | 12/1987 | Reinhardt | |
| 6,823,878 | B1 | 11/2004 | Gadini | |
| 9,435,066 | B2 | 9/2016 | Lee et al. | |
| 2006/0048571 | A1* | 3/2006 | Lee | G01F 23/38 73/313 |
| 2009/0120135 | A1 | 5/2009 | Gill et al. | |
| 2010/0000027 | A1 | 1/2010 | Bae et al. | |
| 2014/0157835 | A1* | 6/2014 | Del Pos | D06F 39/007 68/17 R |
| 2015/0017309 | A1 | 1/2015 | Pope-Mayell et al. | |
| 2015/0346018 | A1* | 12/2015 | M | G01F 23/38 73/314 |
| 2016/0010266 | A1* | 1/2016 | Del Pos | D06F 34/28 68/13 A |
| 2018/0073187 | A1 | 3/2018 | Li et al. | |
| 2018/0148881 | A1 | 5/2018 | Alexander et al. | |

FOREIGN PATENT DOCUMENTS

| | | | | |
|---|---|---|---|---|
| CN | 200975969 | Y | 11/2007 | |
| CN | 201648060 | U | 11/2010 | |
| CN | 202329748 | U | 7/2012 | |
| CN | 102953261 | A | 3/2013 | |
| DE | 1642445 | A1 | 4/1971 | |
| DE | 3131543 | A1 | 2/1983 | |
| DE | 3703254 | A1 | 8/1988 | |
| DE | 3710511 | A1 | 10/1988 | |
| DE | 3736311 | A1 * | 5/1989 | D06F 39/007 |
| DE | 4004057 | | 8/1991 | |
| DE | 10204002 | A1 * | 8/2003 | G01N 9/10 |
| EP | 1085118 | A2 | 3/2001 | |
| EP | 1087052 | A2 * | 3/2001 | D06F 39/087 |
| EP | 1211491 | A2 * | 6/2002 | H01H 35/18 |
| EP | 2656771 | A1 | 10/2013 | |
| FR | 2438016 | A1 * | 4/1980 | A47L 15/4231 |
| FR | 2829575 | A1 * | 3/2003 | G01F 23/76 |
| WO | 2014121820 | A1 | 8/2014 | |

OTHER PUBLICATIONS

DE3736311—Machine Translation (Year: 1989).*
FR2829575—Machine Translation (Year: 2003).*
FR2438016—Machine Translation (Year: 1980).*
International Search Report and Written Opinion for International Application No. PCT/EP2016/056550, dated May 31, 2016—11 pages.
Chinese Office Action issued in Chinese Application No. 201680083446.2, dated Jun. 30, 2020 with translation, 20 pages.
USPTO Notice of Allowance issued in U.S. Appl. No. 16/084,412, dated Apr. 2, 2021, 18 pages.
Chinese Office Action issued in Chinese Patent Application No. 201780078492.8, dated Jun. 21, 2021, 8 pages.
USPTO Non Final Office Action issued in U.S. Appl. No. 16/477,352, dated Jul. 21, 2021, 36 pages.

* cited by examiner

Fig. 5
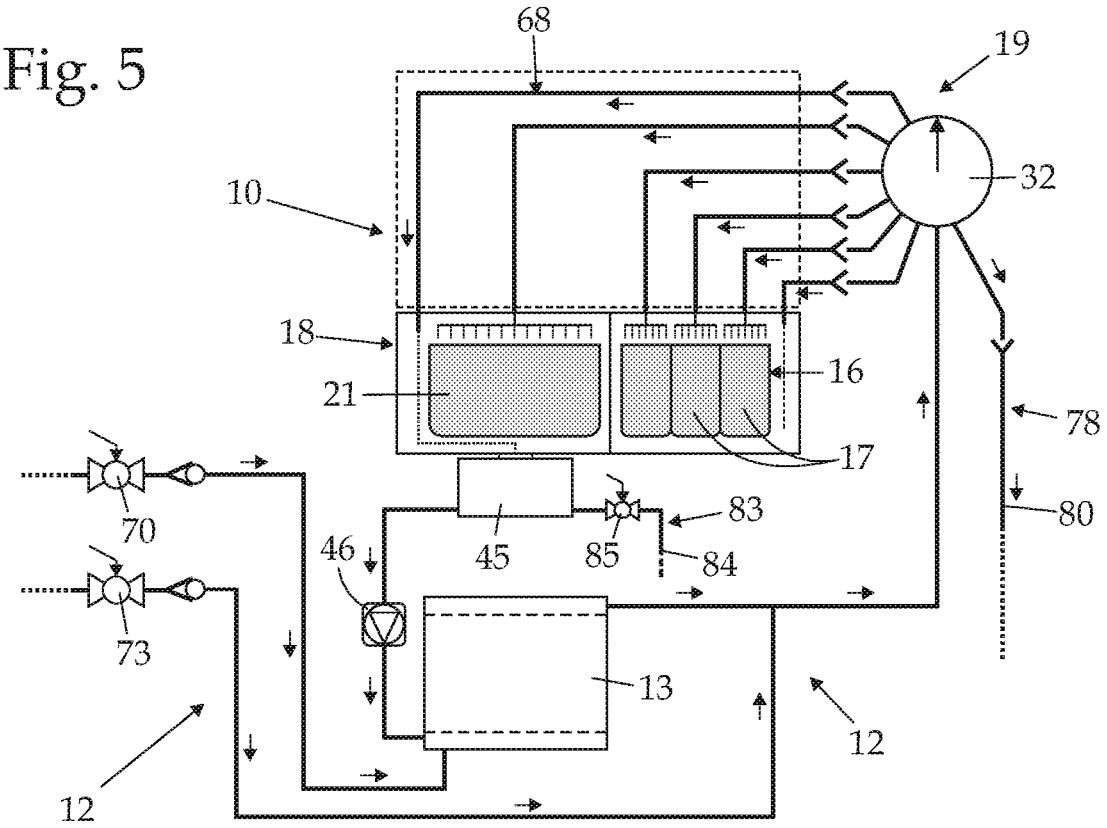
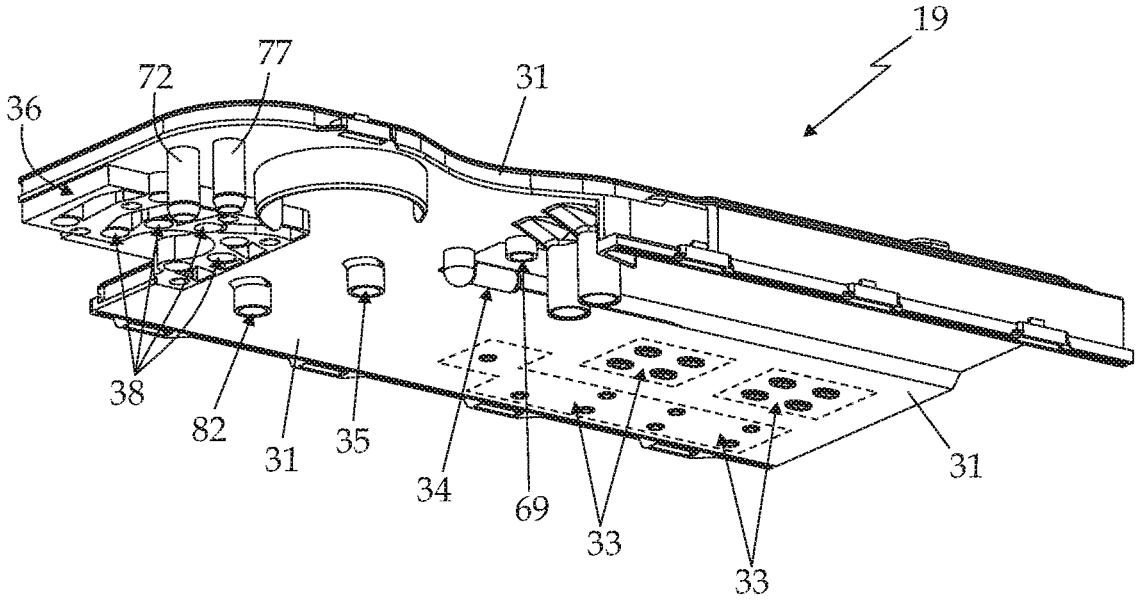
Fig. 9

LAUNDRY WASHING MACHINE COMPRISING A WATER SOFTENING DEVICE

The present invention relates to a laundry washing machine.

More in particular, the present invention relates to a front-loading home laundry washing machine, to which the following description refers purely by way of example without this implying any loss of generality.

As is known, a front-loading home laundry washing machine generally to comprises: a substantially parallelepiped-shaped outer boxlike casing structured for resting on the floor; a substantially horizontally-oriented and approximately cylindrical washing tub which is usually suspended in floating manner inside the casing, with the front mouth directly facing a laundry loading/unloading through opening realized in the front wall of the casing; a substantially cylindrical, cup-shaped rotatable drum structured for housing the laundry to be washed, and which is fitted inside the washing tub with the concavity facing the laundry loading/unloading opening, and is supported by the washing tub in axially rotatable manner so as to be able to freely rotate inside the washing tub about its substantially horizontally-oriented, longitudinal axis; a substantially cylindrical, elastically-deformable bellows which watertight connects the front mouth of the washing tub to the laundry loading/unloading opening formed in the front wall of the casing; a porthole door which is hinged to the front wall of the casing to rotate to and from a closing position in which the door closes the laundry loading/unloading, opening in the front wall of the casing for watertight sealing the washing tub; and an electrically-powered motor assembly which is structured for driving into rotation the rotatable drum about its longitudinal axis inside the washing tub.

This type of laundry washing machine furthermore comprises: a detergent dispenser which is located inside the boxlike casing, immediately above the washing tub, and is structured for selectively feeding into the washing tub, according to the washing cycle manually-selected by the user, a given amount of detergent, softener and/or other washing agent suitably mixed with fresh water arriving from the water mains; a fresh-water supply circuit which is structured for selectively drawing fresh water from the water mains according to the washing cycle manually-selected by the user, and channelling said fresh water to the detergent dispenser or directly to the washing tub; and finally an appliance control panel which is generally located on the front wall of the casing, above the laundry loading/unloading opening, and is structured for allowing the user to manually select the desired washing-cycle.

In addition to the above, high-end front-loading laundry washing machines may optionally have an internal water softening device which is located along the fresh-water supply circuit, and is structured to selectively reduce the hardness degree of the tap water channelled towards the detergent dispenser and the washing tub. The use of softened water during the washing cycle, in fact, significantly improves cleaning performances.

More in detail, the water softening device is generally internally provided with a given amount of ion-exchange resins which are capable of retaining the calcium and magnesium ions (Ca++ and Mg++) dissolved in the water flowing through the same water softening device, so as to reduce the hardness degree of the tap water directed towards the detergent dispenser and the washing tub.

In addition to the above, since the water softening capabilities of the ion-exchange resins are used to quickly drop away after a limited number of washing cycles, this high-end laundry washing machines are generally provided with an internal reservoir of salt (NaCl) to be used for selectively producing some brine (i.e. salt water) which is periodically channeled into the water softening device to regenerate the ion-exchange resins located therein. Salt water, in fact, is able to remove from the ion-exchange resins the calcium and magnesium ions previously combined/fixed to said resins.

More in detail, in high-end front-loading laundry washing machines the salt to be used in the regeneration process of the ion-exchange resins is stowed into a regeneration-agent drawer which is fitted in manually extractable manner into a corresponding drawer housing recessed on front wall of the casing, beside the drawer housing of the detergent drawer of the detergent dispenser. The laundry washing machine is furthermore provided with a water supply line structured to selectively pour a shower of water droplets by gravity into the regeneration-agent drawer thus to solve some of the salt grains contained into the same regeneration-agent drawer and form the brine that drops on the bottom of the drawer housing of the regeneration-agent drawer. An electric pump assembly finally sucks the brine from the bottom of the drawer housing of the regeneration-agent drawer and feeds it to the water softening device.

Preferably a water-level sensor is furthermore incorporated into the drawer housing of the regeneration-agent drawer for measuring the current level of the liquid accumulating on the bottom of the same drawer housing.

Aim of the present invention is to improve performances of today's water softening devices.

In compliance with the above aims, according to the present invention there is provided a laundry washing machine comprising an outer casing and, inside said outer casing, a washing tub, a rotatable drum housed in axially rotatable manner inside the washing tub and structured for housing the laundry to be washed, a detergent dispenser which is structured for supplying detergent into the washing tub, a fresh-water supply circuit which is structured for selectively channelling a flow of fresh water from the water mains towards the detergent dispenser and/or the washing tub, and an internal water softening device filled with a water softening agent capable of reducing the hardness degree of the fresh water directed towards the detergent dispenser or the washing tub; the laundry washing machine being characterized by additionally comprising: a regeneration-agent reservoir located/recessed inside the outer casing and structured for being manually fillable with a given amount of consumable salt or other regeneration agent; a first water-supply line which is structured for selectively channelling a flow of fresh water into said regeneration-agent reservoir so as to form some brine; a brine reservoir which is fluidically connected to said regeneration-agent reservoir for receiving and accumulating the brine arriving from said regeneration-agent reservoir; and a detector assembly which is associated to the brine reservoir and is capable of detecting when the salinity degree of the brine stored into brine reservoir exceeds a predetermined minimum salinity value.

Preferably, though not necessarily, the laundry washing machine is furthermore characterized in that said detector assembly is also capable of detecting when the level of the water or brine stored inside brine reservoir is equal to or higher than a predetermined first threshold value.

Preferably, though not necessarily, the laundry washing machine is furthermore characterized in that said predetermined minimum salinity value is a salinity value sufficient to successfully perform the regeneration process of the water softening agent contained into the water softening device.

Preferably, though not necessarily, the laundry washing machine is furthermore characterized in that said detector assembly includes a salinity detector device that comprises: a first floating body which has a nominal density higher than that of the fresh water, and is housed inside the brine reservoir with the capability to move upwards and downwards; and a corresponding first electronic control unit capable of monitoring the position of said first floating body.

Preferably, though not necessarily, the laundry washing machine is furthermore characterized in that said first floating body has a nominal density higher than that of the fresh water and lower than that of the brine having a salinity degree equal to said minimum salinity value, so as to float only in presence of selected brines having a salinity degree equal to or higher that said minimum salinity value.

Preferably, though not necessarily, the laundry washing machine is furthermore characterized in that said first floating body is housed inside the brine reservoir with the capability to move upwards and downwards between a lowered position and a raised position; and in that said first electronic control unit is capable of detecting when said first floating body reaches said specific raised position inside the brine reservoir.

Preferably, though not necessarily, the laundry washing machine is furthermore characterized in that said first floating body is rigidly attach to the distal end of a first guide arm which is pivotally jointed to the brine reservoir so as to be able to freely swing up and down inside the brine reservoir.

Preferably, though not necessarily, the laundry washing machine is furthermore characterized in that said first electronic control unit comprises a presence sensor which is capable of detecting when said first floating body is a raised position.

Preferably, though not necessarily, the laundry washing machine is furthermore characterized in that said first electronic control unit is located on top of said brine reservoir and comprises a presence sensor which is capable of detecting when said first floating body substantially abuts against the top wall of said brine reservoir.

Preferably, though not necessarily, the laundry washing machine is furthermore characterized by comprising user warning means and a central control unit capable of activating said user warning means when the detector assembly detects, preferably either for the first time or after a given number of consecutive times, a low salinity degree conditions.

Preferably, though not necessarily, the laundry washing machine is furthermore characterized in that said detector assembly includes a water-level detector device that comprises: a second floating body which has a nominal density lower than that of the fresh water, and is housed inside the brine reservoir with the capability to freely move upwards and downwards; and a corresponding second electronic control unit capable of monitoring the position of said second floating body.

Preferably, though not necessarily, the laundry washing machine is furthermore characterized in that said second floating body is housed inside the brine reservoir with the capability to move upwards and downwards between a lowered position and a raised position; and in that said second electronic control unit is capable of detecting when said second floating body reaches said specific raised position inside the brine reservoir; the raised position of said second floating body corresponding to a level of fresh water or brine inside the brine reservoir equal to or exceeding said first threshold value.

Preferably, though not necessarily, the laundry washing machine is furthermore characterized in that said second floating body is rigidly attach to the distal end of a second guide arm which is pivotally jointed to the brine reservoir so as to be able to freely swing up and down inside the brine reservoir.

Preferably, though not necessarily, the laundry washing machine is furthermore characterized in that said second electronic control unit comprises a presence sensor which is capable of detecting when said second floating body is a raised position.

Preferably, though not necessarily, the laundry washing machine is furthermore characterized in that said second electronic control unit is located on top of said brine reservoir, and comprises a presence sensor which is capable of detecting when said second floating body substantially abuts against the top wall of said brine reservoir.

Preferably, though not necessarily, the laundry washing machine is furthermore characterized in that said first and second guide arm are fitted in axially rotatable manner on a common supporting pin or shaft extending inside the brine reservoir.

Preferably, though not necessarily, the laundry washing machine is furthermore characterized in that said first and second electronic control unit are incorporated on a single control board located on top wall of said brine reservoir.

Preferably, though not necessarily, the laundry washing machine is furthermore characterized in that said first and/or said second floating body cooperate/s with the corresponding presence sensor/s.

Preferably, though not necessarily, the laundry washing machine is furthermore characterized in that the presence sensor of said first or said second electronic control unit comprises a mechanical transducer, an optical transducer, or a magnetic transducer.

Preferably, though not necessarily, the laundry washing machine is furthermore characterized in that said brine reservoir fluidly communicates with the water softening device via a pump assembly which is capable of selectively pumping the brine accumulated into the brine reservoir, from the brine reservoir to the water softening device.

Preferably, though not necessarily, the laundry washing machine is furthermore characterized by comprising at least a first drawer which is fitted/inserted in extractable manner into a corresponding first drawer housing, and in that said regeneration-agent reservoir is a substantially basin-shaped, regeneration-agent compartment formed on said first drawer.

Preferably, though not necessarily, the laundry washing machine is furthermore characterized in that said brine reservoir is a discrete brine tank which is attached to the bottom of said first drawer housing, and communicates with the basin-shaped bottom portion of said first drawer housing via a vertical pipe-extension that protrudes downwards from the bottom of said first drawer housing and fits into a complementary brine inlet opening formed on top wall of said brine tank.

Preferably, though not necessarily, the laundry washing machine is furthermore characterized in that said first drawer is additionally provided with one or more detergent compartments which are arranged beside the regeneration-agent compartment and are each structured for being manually fillable with a given amount of detergent, softener or other washing agent.

Preferably, though not necessarily, the laundry washing machine is furthermore characterized in that said detergent dispenser furthermore comprises a drawer flush circuit which is connected to the fresh-water supply circuit, and is structured for selectively pouring the fresh water of the fresh-water supply circuit into any one of said detergent compartments to selectively flush the detergent, softener or other washing agent out of the same detergent compartment, and also into the regeneration-agent compartment to form the brine.

Preferably, though not necessarily, the laundry washing machine is furthermore characterized in that said regeneration-agent compartment is provided, on the bottom, with a brine outlet, and in that said first drawer additionally comprises a partitioning septum that covers said brine outlet and has a water-permeable structure designed to slow down the outflow of the brine from the regeneration-agent compartment via the brine outlet thus to cause a temporary stagnation of the water above the partitioning septum.

Preferably, though not necessarily, the laundry washing machine is furthermore characterized in that said water softening device contains a given amount of ion-exchange resins capable of retaining the calcium and magnesium ions dissolved in the water that flows through the same water softening device.

Preferably, though not necessarily, the laundry washing machine is furthermore characterized in that said regeneration-agent reservoir is dimensioned to accommodate an amount of consumable salt or other regeneration agent sufficient for performing one or more regeneration processes of water softening capabilities of the water softening agent contained into the water softening device.

A non-limiting embodiment of the present invention will now be described, by way of example, with reference to the accompanying drawings, in which:

FIG. 5 is a schematic view of part of the hydraulic circuit of the FIG. 1 laundry washing machine;

FIG. 9 is a perspective view of the upper lid of the drawer housing of the detergent dispensing assembly shown in FIGS. 6 and 7;

FIG. 12 is an enlarged and partially exploded perspective view of part of a second embodiment of the detergent dispensing assembly shown in FIGS. 10 and 11, with parts removed for clarity; whereas

Figure 2:
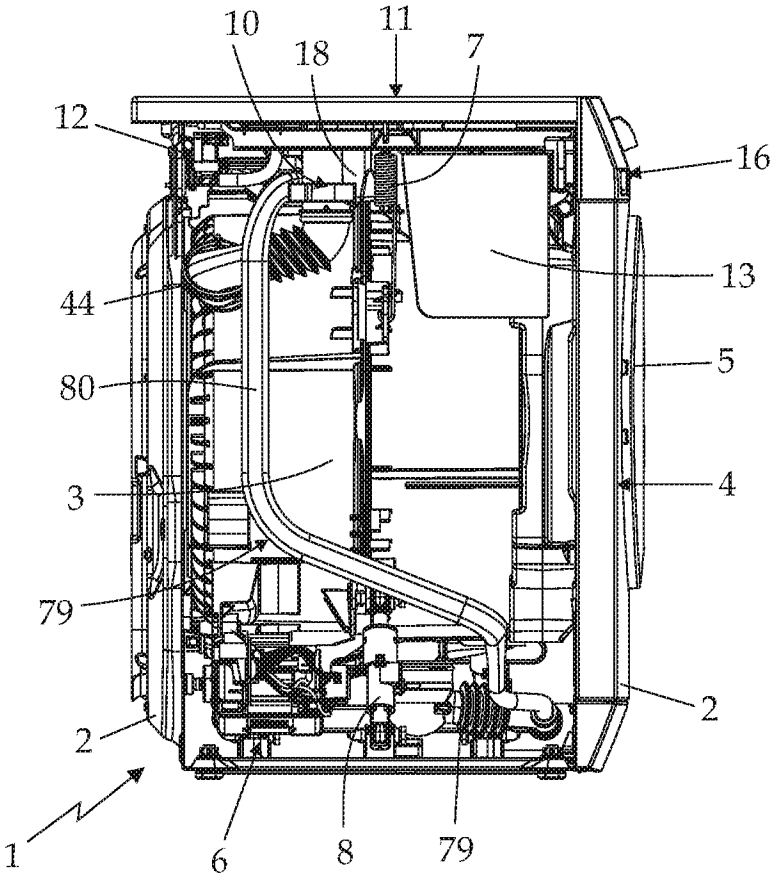
FIG. 2 is a side view of the FIG. 1 laundry washing machine, with parts removed for clarity.
Figure 1:
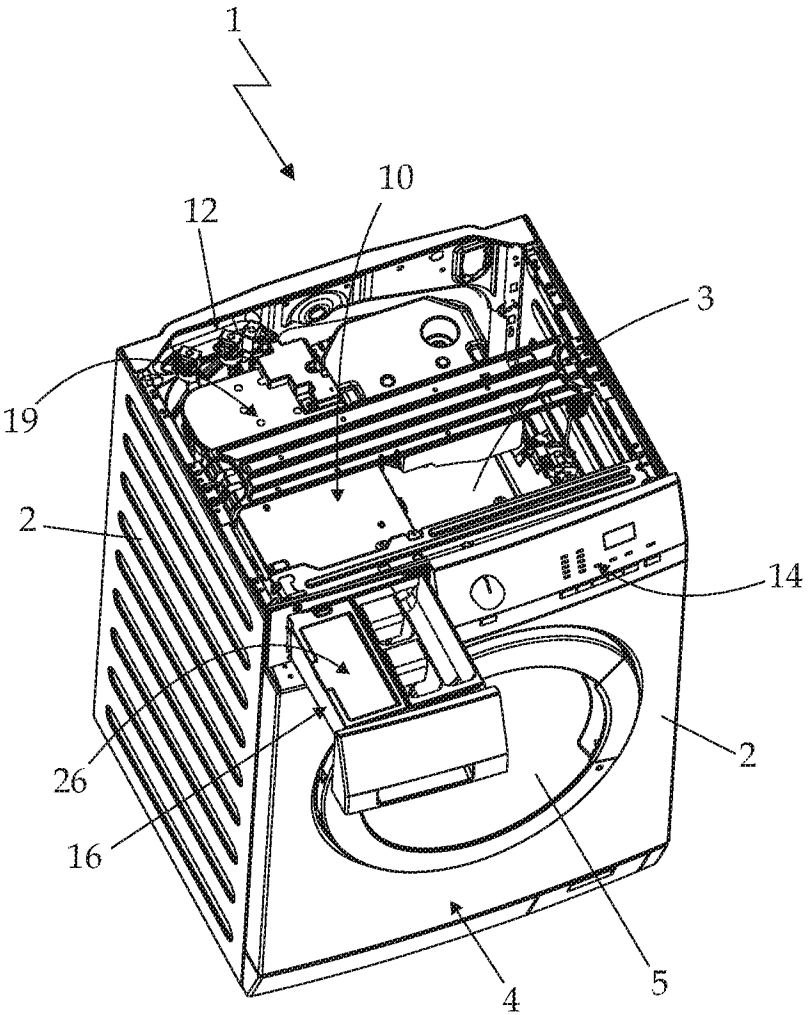
FIG. 1 is a perspective view of a laundry washing machine realized in accordance with the teachings of the present invention, with parts removed for clarity.
Figure 3:
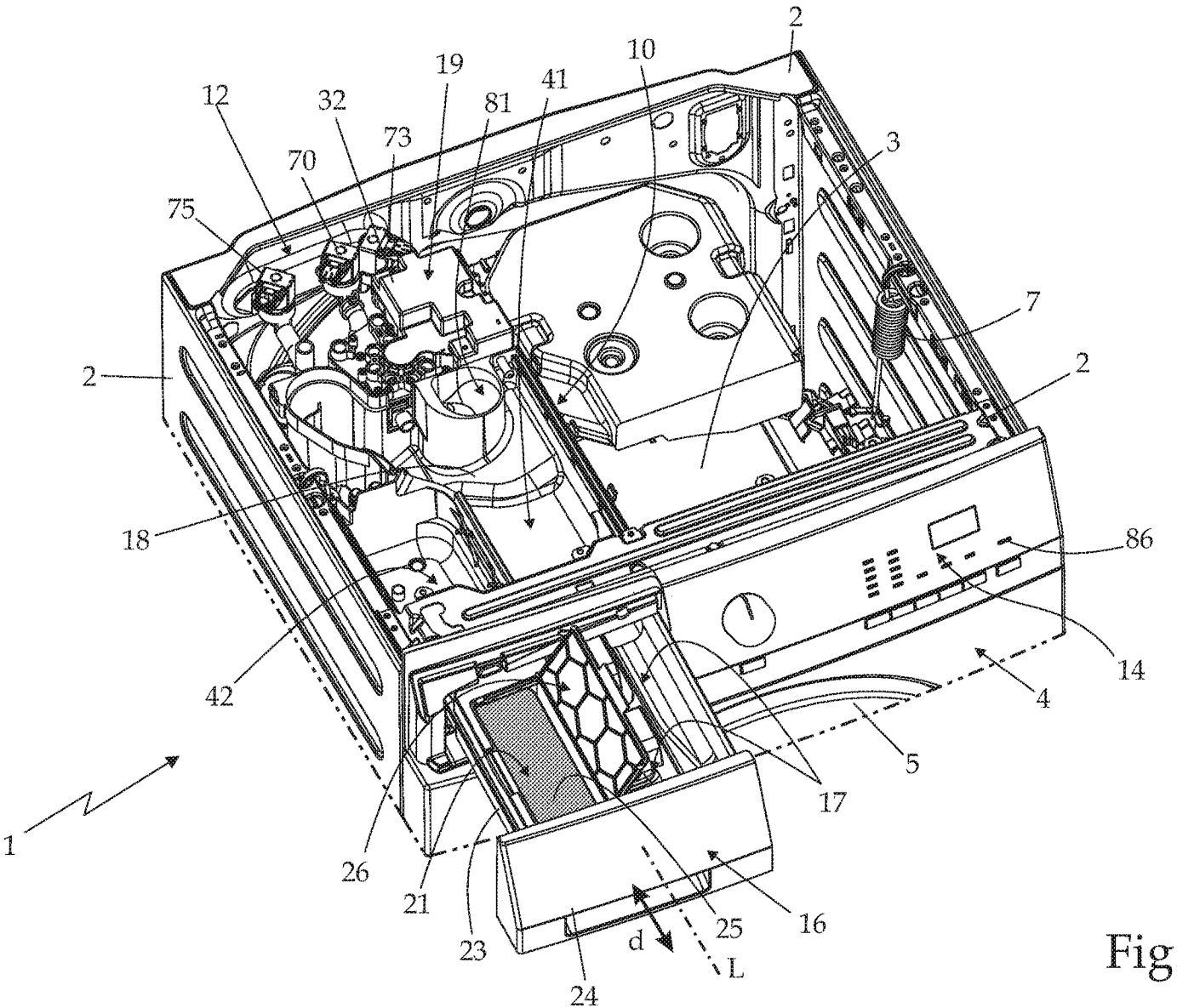
FIG. 3 is an enlarged perspective view of the top portion of the FIG. 1 laundry washing machine, with parts removed for clarity.

With reference to FIGS. 1, 2 and 3, reference number 1 indicates as a whole a laundry washing machine 1 which preferably basically comprises: a preferably substantially parallelepiped-shaped, outer boxlike casing 2 structured for resting on the floor; a preferably substantially horizontally-oriented, approximately cylindrical washing tub 3 which is arranged inside the casing 2 with the mouth directly facing a laundry loading/unloading pass-through opening realized in the front wall 4 of the outer casing 2; a substantially cylindrical, cup-shaped rotatable drum (not shown) which is structured for housing the laundry to be washed, and is fitted in axially rotatable manner inside the washing tub 3 with the concavity facing the front opening or mouth of washing tub 3, so as to be able to freely rotate about its longitudinal axis inside the washing tub 3; a porthole door 5 which is hinged to the front wall 4 of casing 2 so as to be movable to and from a closing position in which the door 5 closes the laundry loading/unloading opening on front wall 4 for watertight sealing the washing tub 4; and an electrically-powered motor assembly 6 which is structured for driving into rotation the rotatable drum (not shown) about its longitudinal axis inside the washing tub 3.

In the example shown, in particular, the rotatable drum (not shown) of laundry washing machine 1 is preferably arranged inside the washing tub 3 with the drum rotation axis locally substantially coaxial to the longitudinal axis of washing tub 3, i.e. oriented substantially horizontally, and with the circular front opening or mouth of the drum directly aligned and faced to the circular front opening or mouth of washing tub 3, so as to receive the laundry to be washed through the laundry loading/unloading opening realized on front wall 4.

The washing tub 3, in turn, is preferably suspended in floating manner inside the casing 2 via a suspension system that preferably, though not necessarily, comprises at least one, and preferably a couple of upper coil springs 7 connecting the upper portion of washing tub 3 to the top of casing 2, and preferably at least one, and preferably a couple of vibration dampers 8 connecting the bottom portion of washing tub 3 to the bottom of casing 2. Moreover the laundry washing machine 1 is preferably provided with a substantially cylindrical elastically-deformable bellows (not shown) which watertight connects the front mouth of washing tub 3 to the laundry loading/unloading, opening realized on front wall 4 of casing 2.

With reference to FIGS. 1, 2, 3 and 4, the laundry washing machine 1 furthermore comprises: a detergent dispenser 10 which is located inside the casing 2 preferably above the washing tub 3 and preferably, though not necessarily, immediately underneath the upper worktop or top wall 11 of casing 2, and is structured for selectively feeding into the washing tub 3, according to the washing cycle manually-selected by the user, a given amount of detergent, softener and/or other washing agent suitably mixed with fresh water; a main fresh-water supply circuit 12 which is connectable directly to the water mains, and is structured for selectively channelling, according to the washing cycle manually-selected by the user, a flow of fresh water from the water mains to the detergent dispenser 10 or directly to the washing tub 3; and an internal water softening device 13 which is located inside the boxlike casing 2, along the fresh-water supply circuit 12 or along the detergent dispenser 10, and is structured for selectively reducing, during each washing cycle, the hardness degree of the tap water that fresh-water supply circuit 12 channels towards detergent dispenser 10 or washing tub 3.

More in detail, the water softening device 13 basically consists in a closed container which has a water inlet and a water outlet fluidically connected to the fresh-water supply circuit 12 and/or the detergent dispenser 10 so as to be crossed by the tap water directed towards the washing tub 3, and which is furthermore filled with a given amount of ion-exchange resins capable of retaining the calcium and magnesium ions (Ca++ and Mg++) dissolved in the water flowing through the same container, so as to reduce the hardness degree of the tap water directed towards the washing tub 3.

In the example shown, in particular, the water softening device 13 is preferably located inside the boxlike casing 2 adjoined to the detergent dispenser 10, and is preferably fluidically connected directly to detergent dispenser 10 so as to be crossed by the fresh water flowing along the detergent dispenser 10 towards the washing tub 3.

With reference to FIGS. 1 and 3, in addition to the above, the laundry washing machine 1 preferably moreover comprises an appliance control panel 14 which is preferably located on front wall 4 of casing 2, above the laundry loading/unloading opening and preferably also immediately beneath the upper worktop or top wall 11 of casing 2, and is structured to allow the user to manually select the desired washing cycle among a number of available washing cycles.

With reference to FIGS. 1-8, detergent dispenser 10 in turn basically comprises: a detergent drawer 16 which is provided with one or more substantially basin-shaped, detergent compartments 17 (three detergent compartments 17 in the example shown) each structured for being manually tillable with a given amount of detergent, softener or other washing agent, and which is fitted/inserted in manually extractable manner into a corresponding preferably substantially basin-shaped, drawer housing 18 which, in turn, is located/recessed inside the casing 2 above washing tub 3, and whose entrance is preferably located on front wall 4 of casing 2, above the laundry loading/unloading opening realized on the same front wall 4; and preferably a drawer flush circuit 19 which is connected to the fresh-water supply circuit 12, and is structured for selectively channelling/pouring, when the detergent drawer 16 is completely fitted/inserted into drawer housing 18, the fresh water of the water mains into any one of the detergent compartments 17 of detergent drawer 16 so as to selectively flush the detergent, softener or other washing agent out of the same detergent compartment 17 and down onto the bottom of drawer housing 18.

More in detail, detergent drawer 16 is preferably movable inside the drawer housing 18 parallel to the substantially horizontally-oriented, longitudinal axis L of drawer housing 18 between:

- a retracted position (see FIG. 2) in which detergent drawer 16 is completely fitted/inserted into drawer housing 18, so as to be almost completely recessed into the front wall 4 of casing 2; and
- a completely extracted position (see FIGS. 1, 3, 4 and 6) in which detergent drawer 16 partly juts out from the front wall 4 of casing 2, so as to expose the one or more detergent compartments 17 at once.

In other words, detergent drawer 16 is movable inside the drawer housing 18 in a substantially horizontally-oriented, displacement direction d which is locally substantially parallel to the longitudinal axis L of both drawer housing 18 and detergent drawer 16, between:

- a retracted position (see FIG. 2) in which detergent drawer 16 is almost completely recessed into the front wall 4 of casing 2 and the one or more detergent compartments 17 of detergent drawer 16 are inaccessible to the user; and
- a completely extracted position (see FIGS. 1, 3, 4 and 6) in which detergent drawer 16 partly juts out from the front wall 4 of casing 2, so that all detergent compartments 17 of detergent drawer 16 are fully accessible to the user at same time.

In the example shown, in particular, the entrance of drawer housing 18 is preferably located on front wall 4 of casing 2, immediately underneath the upper worktop or top wall 11 of casing 2 and substantially horizontally aligned beside the appliance control panel 14. Moreover the longitudinal axis L of both detergent drawer 16 and drawer housing 18 and, as a consequence, the displacement direction d of detergent drawer 16 are preferably locally substantially perpendicular to front wall 4 of casing 2.

Preferably each detergent compartment 17 is furthermore dimensioned to contain a given amount of detergent, softener or other washing agent sufficient for performing only a single washing cycle.

In addition to the above, the detergent drawer 16 preferably has, inside each detergent compartment 17, a siphon assembly suitably structured/dimensioned to selectively channel the mixture of water and detergent, softener or other washing agent formed inside the detergent compartment 17 out of the same detergent compartment 17 and down onto the bottom of drawer housing 18.

As an alternative to the siphon assembly, the detergent drawer 16 may have, on the bottom of the detergent compartment 17, a large pass-through opening which is suitably shaped/dimensioned to allow the mixture of water and detergent, softener or other washing agent formed inside the same detergent compartment 17 to freely fall on the bottom of drawer housing 18.

The drawer flush circuit 19, in turn, is preferably structured for directly pouring, when detergent drawer 16 is placed in the retracted position, a shower of water droplets by gravity selectively and alternatively into any one of the detergent compartments 17 of detergent drawer 16, so as to selectively flush the detergent, softener or other washing agent out of the same detergent compartment 17 and down onto the bottom of drawer housing 18.

In addition to the above, with reference to FIGS. 3 to 8, detergent drawer 16 is preferably furthermore provided with a substantially basin-shaped, regeneration-agent compartment 21 which is located beside the one or more detergent compartments 17, and is structured for being manually fillable with a given quantity of salt grains (NaCl) or other regeneration agent suitable to be used in the regeneration process of the ion-exchange resins of the water softening device 13.

The drawer flush circuit 19, in turn, is preferably additionally structured for selectively channelling, when detergent drawer 16 is placed in the retracted position, the fresh water of the water mains also into the regeneration-agent compartment 21, so as to dissolve some of the salt grains contained into the same regeneration-agent compartment 21 and form brine (i.e. salt water).

More in details, the regeneration-agent compartment 21 is preferably arranged, on detergent drawer 16, beside the one or more detergent compartments 17 transversally to the displacement direction d of detergent drawer 16, so that both detergent compartment/s 17 and regeneration-agent compartment 21 are allowed to almost contemporaneously come out from the front wall 4 of casing 2 when detergent drawer 16 moves from the retracted position to the extracted position.

Detergent drawer 16 is therefore movable inside drawer housing 18 in the substantially horizontally-oriented, displacement direction d between:

- a retracted position (see FIG. 2) in which detergent drawer 16 is completely recessed into the front wall 4 of casing 2, so that both the detergent compartment/s 17 and the regeneration-agent compartment 21 are inaccessible to the user; and
- a completely extracted position (see FIGS. 1, 3, 4 and 5) in which detergent drawer 16 partly juts out from the front wall 4 of casing 2, so that both the detergent compartment/s 17 and the regeneration-agent compartment 21 are simultaneously exposed and fully accessible to the user.

Preferably the regeneration-agent compartment 21 is moreover dimensioned to accommodate/contain an amount of consumable salt (NaCl) or other regeneration agent sufficient for performing a plurality of regeneration processes of the ion-exchange resins of the water softening device 11.

Figure 8:
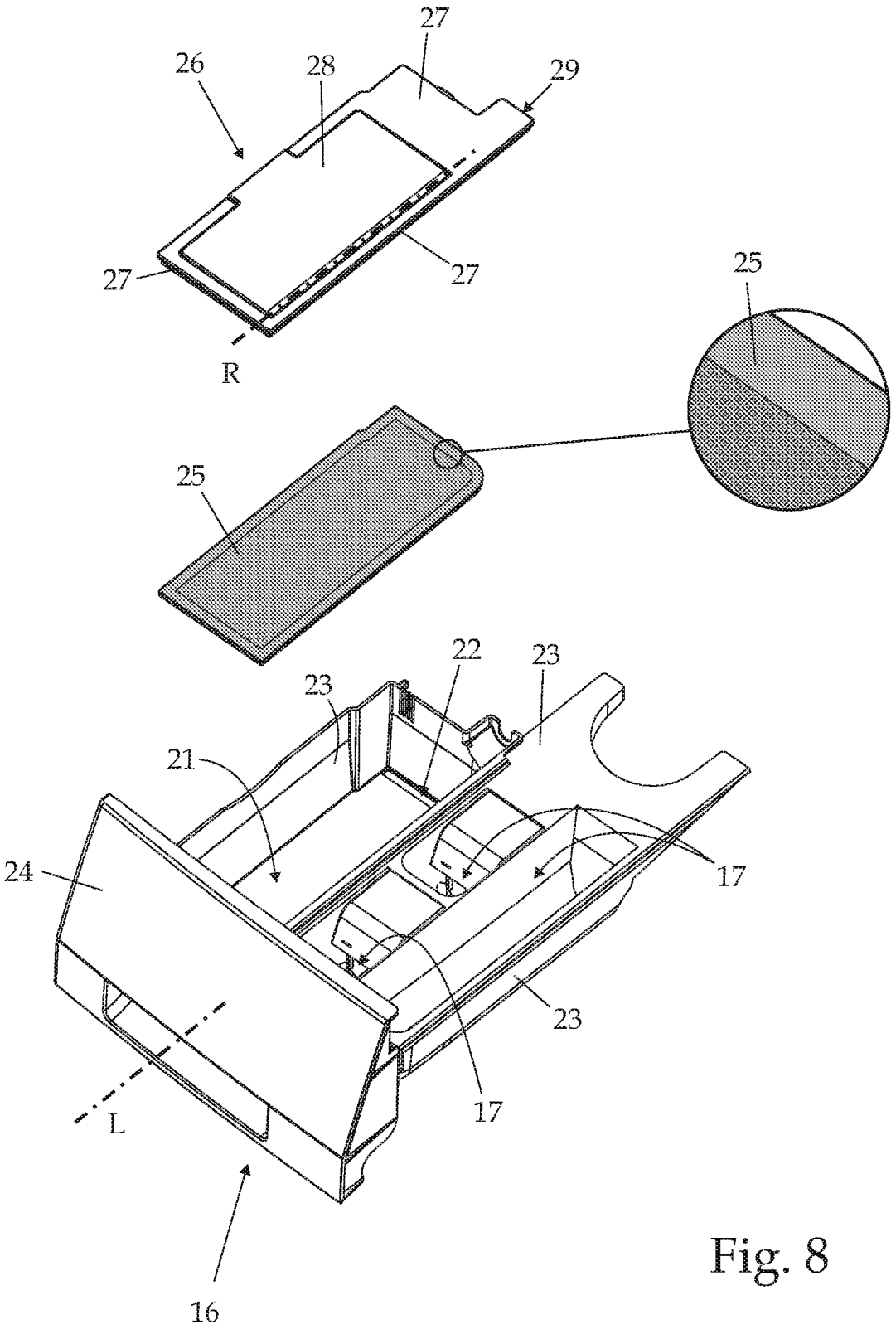
FIG. 8 is a partially exploded perspective view of the detergent drawer of the detergent dispensing assembly shown in FIGS. 6 and 7, with parts removed for clarity.

With reference to FIG. 8, in addition to the above the detergent drawer 16 preferably has, on the bottom of regeneration-agent compartment 21, a large pass-through draining opening 22 which is suitably shaped/dimensioned to allow the brine (i.e. the salt water) formed inside the regeneration-agent compartment 21 to freely fall on the bottom of drawer housing 18.

More in detail, with reference to FIGS. 3 to 8, in the example shown detergent drawer 16 preferably comprises: a drawer main body 23 which is preferably made in a one piece construction, and is fitted/inserted in axially sliding manner into the drawer housing 18; and a manually-sizable front panel 24 which is arranged/located on a front side of the drawer main body 23, so as to close the entrance of drawer housing 18 when detergent drawer 16 is placed in the retracted position (see FIG. 2). The one or more basin-shaped detergent compartments 17 and the basin-shaped regeneration-agent compartment 21 are formed directly on the drawer main body 23 one side by side the other.

With reference to FIGS. 4, 5, 6 and 7, the drawer flush circuit 19, in turn, is preferably directly connected to the fresh-water supply circuit 12 for receiving the fresh water of the water mains, and is suitably structured for selectively pouring/channeling, when the detergent drawer 16 is completely fitted/inserted into drawer housing 18, the fresh water arriving from the fresh-water supply circuit 12 into any one of detergent compartments 17 of detergent drawer 16, or into the regeneration-agent compartment 21 of detergent drawer 16.

In case of detergent compartment/s 17, the poured fresh water serves to selectively flush the contents of the detergent compartment 17 out of the same compartment 17 and down on the bottom of drawer housing 18 via the corresponding siphon assembly. In case of regeneration-agent compartment 21, the poured fresh water serves to dissolve some of the salt grains contained into the regeneration-agent compartment 21 to form the brine (i.e. the salt water) that falls on the bottom of drawer housing 18 via pass-through opening 22.

Figure 7:
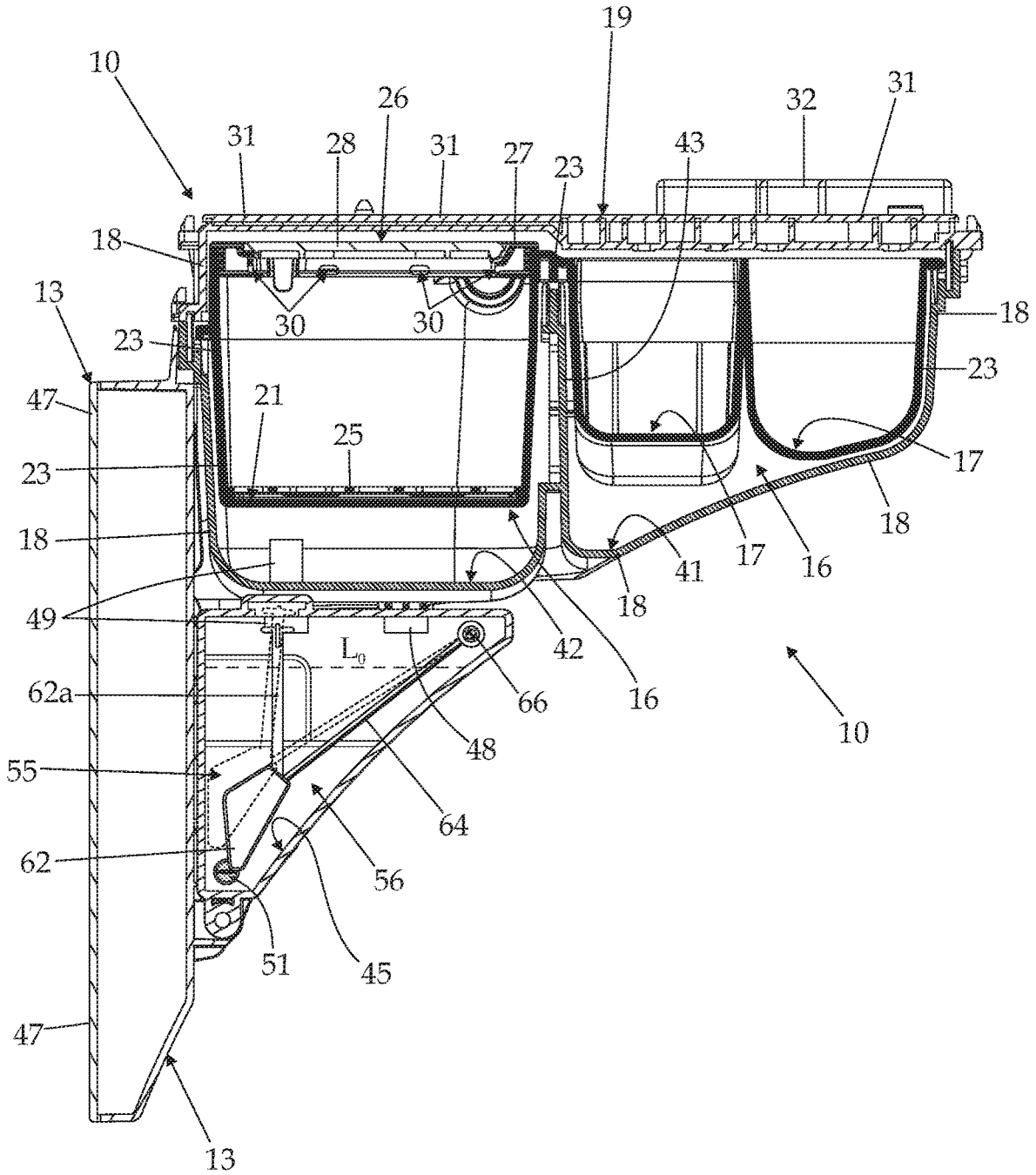
FIG. 7 is a sectioned front view of the detergent dispensing assembly shown in FIGS. 4 and 6, with parts removed for clarity.

With reference to FIGS. 3, 7 and 8, the detergent drawer 16 is preferably additionally provided with a preferably manually-removable, water-permeable partitioning septum 25 which extends inside the regeneration-agent compartment 21 immediately above the bottom of regeneration-agent compartment 21 and its large pass-through opening 22, and has a water-permeable structure designed for preventing the grains of consumable salt to come out of the regeneration-agent compartment 21 via the pass-through opening 22 and, at same time, for allowing the brine to trickle onto the bottom of the regeneration-agent compartment 21 and then freely flow by gravity towards the pass-through opening 22.

Preferably the partitioning septum 25 furthermore has a water-permeable structure suitably designed to slow down the outflow of the brine from the regeneration-agent compartment 21 via opening 22 thus to cause a temporarily stagnation of the water poured into the regeneration-agent compartment 21, above the same partitioning septum 25.

In other words, the water-permeable partitioning septum 25 is arranged above the pass-through opening 22 so as to completely cover the latter, and is preferably structured to allow the passage of the water/brine through the same partitioning septum 25 with a flowrate which is lower than that of the fresh water poured into the regeneration-agent compartment 21 by drawer flush circuit 19, thus to cause the stagnation of the fresh water above the partitioning septum 25.

Preferably the water-permeable partitioning septum 25 furthermore extends inside regeneration-agent compartment 21 slightly spaced from, and preferably also locally substantially parallel to, the bottom of regeneration-agent compartment 21, so as to form a thin air gap immediately above the bottom of regeneration-agent compartment 21.

In the example shown, in particular, the water-permeable partitioning septum 25 preferably consists in a rigid plate-like element 25 preferably made of plastic material, which substantially copies the shape of the bottom of regeneration-agent compartment 21, and has a microperforated structure which is suitably dimensioned to cause a prolonged stagnation of the water poured into the regeneration-agent compartment 21 above the partitioning septum 25.

More in detail, the central portion of plate-like element 25 is preferably provided with a plenty of substantially evenly distributed, transversal pass-through microholes or micro-slots each preferably having a cross-sectional area lower that 3 $mm^2$ (square millimetres), so as to allow the flow/passage of the brine/water through the partitioning septum 25 with a flowrate preferably ranging between 0.4 and 1 litre/min (litre per minute). The flowrate of the fresh water poured into the regeneration-agent compartment 21 instead preferably ranges between 5 and 8 litre/min (litre per minute).

With reference to FIGS. 3 to 8, the detergent drawer 16 preferably, though not necessarily, additionally comprises a manually openable, upper lid assembly 26 which is firmly fitted on the drawer main body 23, on top of the regeneration-agent compartment 21, and is structured to selectively close the upper mouth of regeneration-agent compartment 21, preferably so as to almost completely cover the upper mouth of regeneration-agent compartment 21. Furthermore, this upper lid assembly is additionally structured so as to be able to receive, from drawer flush circuit 19 and at least when detergent drawer 16 is placed in the retracted position, a flow of fresh water of the water mains and to channel said water into the beneath-located regeneration-agent compartment 21, preferably while spreading out the same fresh water inside the regeneration-agent compartment 21.

In other words, the upper lid assembly 26 is preferably provided with a water inlet which is faced to the outside of regeneration-agent compartment 21 and is structured to allow the fresh water to enter into the same upper lid assembly 26, and with one or more water outlets which are faced to the inside of regeneration-agent compartment 21, fluidically communicate with said water inlet, and are finally suitably structured to allow the water entered into the upper lid assembly 26 through the water inlet to come out of the lid assembly 26 and fall into the regeneration-agent compartment 21.

The drawer flush circuit 19, in turn, is preferably structured to selectively channel, when detergent drawer 16 is placed in the retracted position, a flow of fresh water towards the water inlet of the upper lid assembly 26.

In other words, drawer flush circuit 19 is preferably additionally structured to selectively channel, when detergent drawer 16 is placed in the retracted position, the fresh water arriving from fresh-water supply circuit 12 towards the water inlet of lid assembly 26 which, in turn, is structured to distribute the fresh water arriving from drawer flush circuit 19 into the regeneration-agent compartment 21, so as to dissolve some of the salt grains (NaCl) contained into the regeneration-agent compartment 21 and form the brine that falls on the bottom of drawer housing 18 via opening 22.

Drawer flush circuit 19 is therefore directly connected to the fresh-water supply circuit 12 for receiving the fresh water of the water mains, and is preferably suitably structured for selectively and alternatively channelling, when the detergent drawer 16 is completely fitted/inserted into drawer housing 18, the fresh water arriving from fresh-water supply circuit 12 towards any one of the detergent compartments 17, or towards the water inlet of the upper lid assembly 26.

In addition to the above, in the example shown the water inlet of lid assembly 26 is preferably furthermore structured to couple, when the detergent drawer 16 is placed in the retracted position, in a stable, though easy detachable manner, with the drawer flush circuit 19 for receiving the fresh water of the water mains, and the upper lid assembly 26 is preferably structured to drip the fresh water into the regeneration-agent compartment 21.

With reference to FIGS. 3, 4, 6, 7 and 8, in the example shown, in particular, the upper lid assembly 26 preferably comprises: a plate-like element 27 which is structured to rigidly fit into the upper rim of regeneration-agent compartment 21 to substantially completely cover/close the upper mouth of the regeneration-agent compartment 21; and a manually-movable trapdoor 28 which is arranged to close a preferably substantially rectangular-shaped, large pass-through opening which is preferably formed roughly at centre of plate-like element 27, and which is preferably suitably shaped/dimensioned to allow the user to easily manually pour the consumable salt (NaCl) or other regeneration agent into the regeneration-agent compartment 21.

The plate-like element 27 preferably has a hollow structure and is preferably provided with a water inlet 29 which is suitably structured to watertight couple, when detergent drawer 16 is placed in the retracted position, with the drawer flush circuit 19 thus to allow the fresh water to enter into the plate-like element 27; and with one or more water-outlets 30 which are arranged on the lower face of plate-like element 27, preferably all around the central pass-through opening closed by trapdoor 28. Each water-outlet 30 allows the fresh water entered into the plate-like element 27 to slowly come out of plate-like element 27 and freely fall into the regeneration-agent compartment 21.

Preferably the water-outlets 30 of plate-like element 27 are furthermore suitably shaped/structured to pour a shower of water droplets by gravity into the regeneration-agent compartment 21.

The manually-movable trapdoor 28, in turn, is preferably flag-hinged to plate-like element 27 at one of the two major sides of the central pass-through opening, so as to be able to rotate about a rotation axis R locally substantially coplanar to plate-like element 27.

Drawer flush circuit 19, in turn, is preferably structured to selectively couple, when detergent drawer 16 is placed in the retracted position, with the water inlet 29 of plate-like element 27, so as to be able to channel the fresh water of the water mains into the plate-like element 27 of lid assembly 26 which, in turn, distributes said water into the regeneration-agent compartment 21.

More in detail, with reference to FIGS. 4, 5, 6, 7 and 9, the drawer flush circuit 19 of detergent dispenser 10 preferably comprises:

- a plate-like water conveyor 31 which is suitably structured to form the upper lid of the substantially basin-shaped, drawer housing 18, so as to be located immediately above the detergent drawer 16 when the latter is placed in the retracted position, i.e. when the latter is completely inserted/recessed into drawer housing 18, and is provided with a number of water-delivery portions each suitably structured to allow the outflow of water from plate-like water conveyor 31 towards the beneath-located detergent drawer 16; and
- an electrically-operated, water distributor 32 which is coupled/associated to the plate-like water conveyor 31, is connected to the fresh-water supply circuit 12 and/or to the internal water softening device 13 for receiving a flow of unsoftened or softened fresh water, and is suitably structured to selectively channel the unsoftened fresh water arriving from fresh-water supply circuit 12 or the softened fresh water arriving from water softening device 13, towards any one of the water-delivery portions of the plate-like water conveyor 31.

More in detail, with particular reference to FIG. 9, the plate-like water conveyor 31 is provided, on the side directly faced to the inside of drawer housing 18, with a group of first water-delivery portions 33 which are locally substantially vertically aligned, when detergent drawer 16 is placed in the retracted position, each to a respective detergent compartment 17 of detergent drawer 16, and are each suitably structured to allow the slow outflow of the fresh water from the water conveyor 31 towards the beneath-located detergent compartment 17.

In the example shown, in particular, each water-delivery portion 33 of plate-like water conveyor 31 is preferably structured to pour by gravity a shower of water droplets directly into the beneath-located detergent compartment 17 of detergent drawer 16.

Preferably the plate-like water conveyor 31 is furthermore provided, on the side directly faced to the inside of drawer housing 18, with a second water-delivery portion 34 which is locally substantially vertically aligned, when detergent drawer 16 is placed in the retracted position, to the regeneration-agent compartment 21 of detergent drawer 16, and is suitably structured to allow the outflow of the fresh water from the plate-like water conveyor 31 towards the beneath-located regeneration-agent compartment 21.

Figure 6:
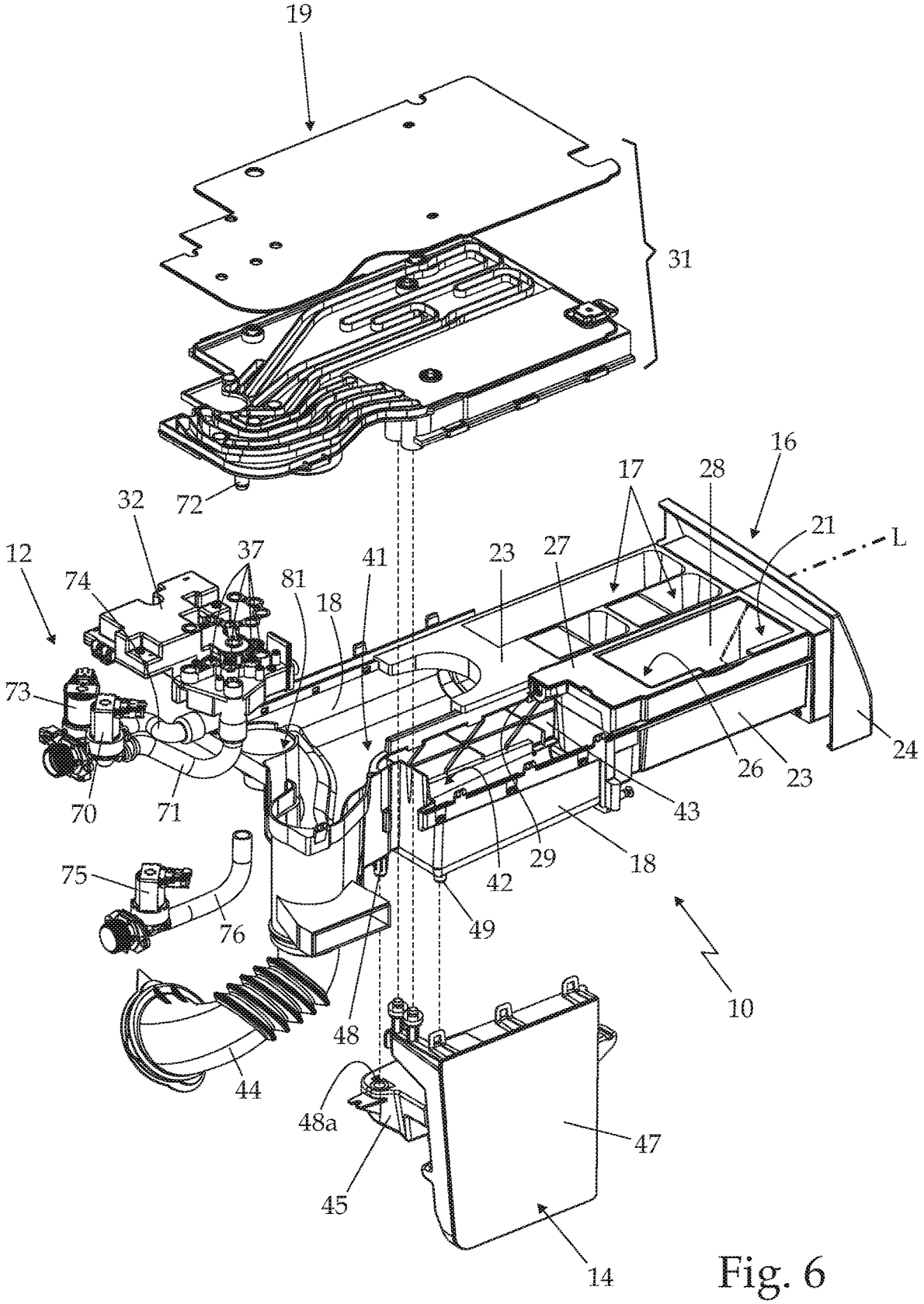
FIG. 6 is a partially exploded perspective view of the detergent dispensing assembly shown in FIG. 4, with parts removed for clarity.

More in detail, with reference to FIGS. 6 and 9, in the example shown the water-delivery portion 34 preferably comprises a male or female hydraulic connector which is suitably structured to couple, when detergent drawer 16 is placed in the retracted position, in detachable manner with a complementary second hydraulic connector which is incorporated into the water inlet 29 of the upper lid assembly 26, or better into the water inlet 29 of plate-like element 27, so as to put the upper lid assembly 26 in fluid communication with the plate-like water conveyor 31.

Preferably the plate-like water conveyor 31 is furthermore provided, on the side directly faced to the inside of drawer housing 18, with a third water-delivery portion 35 which is vertically misaligned to the detergent drawer 16 arranged in retracted position, and is structured to allow the outflow of the water from the plate-like water conveyor 31 directly towards the bottom of drawer housing 18 and then towards the washing tub 3 without affecting the detergent compartment/s 17 of detergent drawer 16.

The electrically-operated, water distributor 32, in turn, is preferably capable of selectively channeling the softened fresh water arriving from water softening device 13 or the unsoftened fresh water arriving from fresh-water supply circuit 12 towards any one of the water-delivery portions 33, 34 and 35, and preferably consists in a discrete, electrically-operated, flow-diverter module 32 which is firmly attached to the outside of plate-like water conveyor 31, at a coupling socket 36 preferably realized on one of the two major faces of the same plate-like water conveyor 31.

The electrically-operated, flow-diverter module 32 preferably has a water inlet which directly communicates with the water softening device 13 for directly receiving softened fresh water, and preferably also with the fresh-water supply circuit 12 for also directly receiving unsoftened fresh water; and a number of water outlets 37 which are located, preferably one side by side the other, at the interface portion of flow-diverter module 32 suited to couple with coupling socket 36 of plate-like water conveyor 31.

Preferably the electrically-operated, flow-diverter module 32 furthermore internally accommodates a rotatable flow diverter (not shown) which is capable of channeling, according to its angular position, the water entering into flow-diverter module 32 via the water inlet towards any one of the water outlets 37 of the same flow-diverter module 32.

In addition to the above, the flow-diverter module 32 preferably moreover comprises an electrically-operated motor assembly (not shown) which is mechanically connected to the rotatable flow diverter for controlling the angular position of the flow diverter; and optionally also an auxiliary electronic control unit (not shown) which is structured to directly power and control the electrically-operated motor assembly according to electric signals arriving from the main electronic central control unit (not shown) of the laundry washing machine 1.

With reference to FIGS. 6 and 9, the plate-like water conveyor 31, on the other hand, is provided with a number of water inlets 38 which are located at coupling socket 36 and separately fluidically communicate each with a respective water-delivery portion 33, 34, 35 of the water conveyor 31 via a corresponding internal water channel extending inside the body of the same water conveyor 31. Each water outlet 37 of flow-diverter module 32 is structured to water-tight couple/connect, at coupling socket 36, with a corresponding water inlet 38 of plate-like water conveyor 31, preferably with the interposition of a corresponding annular sealing gasket.

The electrically-operated, flow-diverter module 32 is therefore structured to selectively channel, on command, the water entering into the same flow-diverter module 32 via its water inlet towards any one of the water inlets 38 of the plate-like water conveyor 31.

In addition to the above, in the example shown the water softening device 13 is preferably directly connected to the plate-like water conveyor 31 of drawer flush circuit 19, and the plate-like water conveyor 31 is preferably structured to directly receive the unsoftened fresh water from the fresh-water supply circuit 12, to channel said unsoftened fresh water towards the water inlet of water softening device 13, and to channel the softened fresh water coming out from the water outlet of water softening device 13 towards the water inlet of flow-diverter module 32.

As an alternative, the electrically-operated, water distributor 32 may consists in a valve assembly comprising a number of electrically-operated on-off valves capable of selectively channeling the unsoftened fresh water arriving from fresh-water supply circuit 12 or the softened fresh water arriving from water softening device 13, towards any one of the water inlets 38 of the plate-like water conveyor 31.

With reference to FIGS. 3, 6 and 7, the bottom of drawer housing 18 in turn is preferably divided into two separated and substantially basin-shaped, bottom portions 41 and 42 which are vertically aligned, when detergent drawer 16 is placed in the retracted position, respectively to all detergent compartments 17 and to the regeneration-agent compartment 21.

More in detail, in the example shown the bottom of drawer housing 18 is preferably divided into two separated and substantially basin-shaped bottom portions 41 and 42, which are arranged side by side to one another transversally to the displacement direction d of detergent drawer 16 inside drawer housing 18, i.e. transversally to the longitudinal axis L of drawer housing 18, so as to be vertically aligned, when detergent drawer 16 is placed in the retracted position, one underneath the one or more detergent compartments 17 and the other underneath the regeneration-agent compartment 21. Preferably the basin-shaped bottom portion 41 is furthermore vertically aligned, if present, to the water-delivery portion 35 of plate-like water conveyor 31.

With particular reference to FIGS. 6 and 7, drawer housing 18 preferably furthermore comprises a substantially vertical, partitioning wall 43 that protrudes upwards from the bottom of drawer housing 18 while remaining locally substantially parallel to the displacement direction d of detergent drawer 16, i.e. parallel to the longitudinal axis L of drawer housing 18, and the basin-shaped bottom portions 41 and 42 of drawer housing 18 are arranged on opposite sides of partitioning wall 43.

In other words the vertical partitioning wall 43 is arranged between the two basin-shaped bottom portions 41 and 42 of drawer housing 18.

Detergent drawer 16, in turn, is preferably arranged astride the partitioning wall 43 and the drawer main body 23 is designed so that the one or more detergent compartments 17 and the regeneration-agent compartment 21 are located on opposite sides of partitioning wall 43. Preferably detergent drawer 16 is furthermore structured to additionally abut in sliding manner on the straight upper crest line of partitioning wall 43.

With reference to FIGS. 2 and 6, the basin-shaped bottom portion 41 vertically aligned to the one or more detergent compartments 17 is structured for receiving the mixture of fresh water and detergent, softener or other washing agent falling down from any one of the detergent compartments 17 of detergent drawer 16 via the corresponding siphon assembly, and optionally the water falling down from the water-delivery portion 35 of plate-like water conveyor 31, and communicates with the inside of washing tub 3 preferably via a connecting duct 44 that branches off from the basin-shaped bottom portion 41 of drawer housing 18 and ends directly into the beneath-located washing tub 3, so as to allow the mixture of water and detergent, softener or other washing agent to quickly flow by gravity directly into the washing tub 3.

With reference to FIGS. 4, 5, 6 and 7, the basin-shaped bottom portion 42 vertically aligned to regeneration-agent compartment 21, in turn, is structured for receiving the brine (i.e. the salt water) trickling/falling down from the regeneration-agent compartment 21 via opening 22, and directly fluidically communicates with the inside of a small brine tank 45 which is dimensioned to catch and contain a given amount of brine preferably greater than 100 ml (millilitres), and is arranged underneath the same basin-shaped bottom portion 42 so as to allow the brine to quickly fall/flow by gravity directly into the brine tank 45 and to accumulate therein.

Preferably said brine tank 45 furthermore fluidically communicates with the inside of the water softening device 13 via a small, electrically-powered pump assembly 46 which is capable of selectively pumping the brine (i.e. the salt water) accumulated into the brine tank 45, from brine tank 45 to water softening device 13, and preferably also to watertight isolate the brine tank 45 from the water softening device 13 when deactivated.

The laundry washing machine 1 therefore comprises: a regeneration-agent reservoir, i.e. the regeneration-agent compartment 21 of detergent drawer 16, which is located/recessed inside the casing 2 and is structured for being manually fillable with a given amount of consumable salt (NaCl) or other regeneration agent; a brine reservoir, i.e. brine tank 45, which is dimensioned to contain a given amount of brine preferably greater than 100 ml (millilitres) and fluidically communicates with said regeneration-agent reservoir for receiving and accumulating the brine (i.e. the salt water) coming out from said regeneration-agent reservoir; and preferably also a small, electrically-powered pump assembly 46 having the suction connected to the brine reservoir 45 and the delivery connected to the water softening device 13, thus to be able to selectively pump the brine (i.e. the salt water) from the brine reservoir 45 to the water softening device 13.

In the example shown, in particular, brine tank 45 is preferably dimensioned to contain a maximum amount of brine preferably overapproximating the whole amount of brine to be pumped into the internal water softening device 13 for performing the regeneration process of the ion-exchange resins located inside the same water softening device 13.

More in detail, assuming for example that the overall amount of brine to be pumped into the water softening device 13 for performing the whole regeneration process of the ion-exchange resins is preferably equal to 250 $cm^3$ (cubic centimeters), brine tank 45 is preferably dimensioned to contain a maximum amount of brine preferably equal to 270 $cm^3$ (cubic centimeters).

Figure 4:
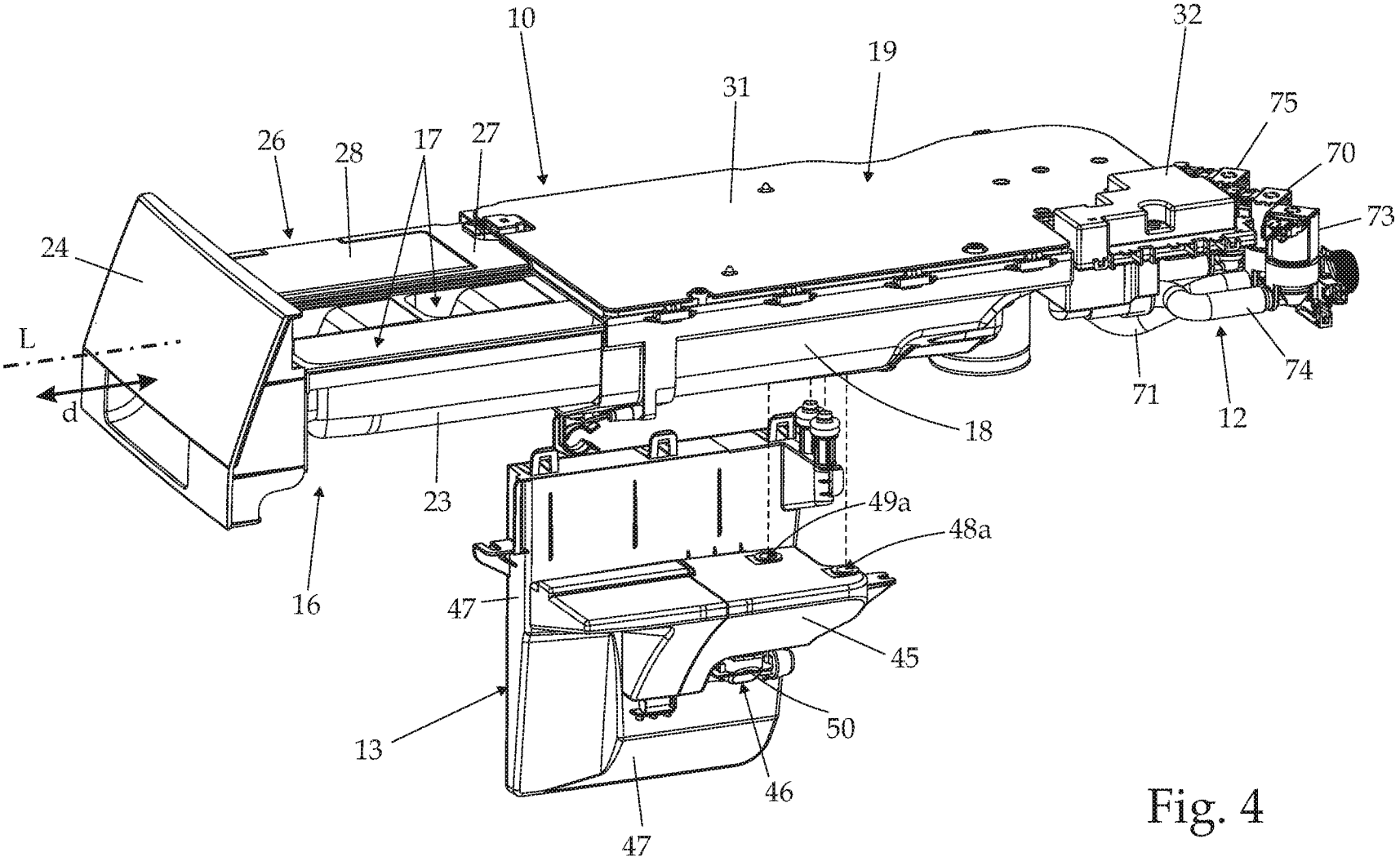
FIG. 4 is a perspective view of the detergent dispensing assembly of the FIG. 1 laundry washing machine, with parts removed for clarity.

With reference to FIGS. 4, 6 and 7, in the example shown, in particular, the water softening device 13 preferably comprises a substantially plate-like, discrete modular cartridge 47 which is provided with a water inlet and a water outlet, and is filled with a given amount of ion-exchange resins capable of retaining the calcium and magnesium ions ($Ca^{++}$ and $Mg^{++}$) dissolved in the water flowing through the same modular cartridge 47.

This modular cartridge 47 is preferably furthermore rigidly attached to a sidewall of drawer housing 18 preferably by means of one or more anchoring screws and/or one or more releasable mechanical couplings, so as to cantilevered extend downwards beyond the bottom of drawer housing 18 and next to brine tank 45, preferably while remaining locally substantially parallel and tangent to a vertical sidewall of the outer casing 2.

Preferably the water inlet and a water outlet of modular cartridge 47 are additionally fluidically connected to the plate-like water conveyor 31 preferably via appropriate hydraulic connectors, so that the modular cartridge 47 is crossable by the unsoftened fresh water arriving from freshwater supply circuit 12 and flowing inside the plate-like water conveyor 31 directed towards the water inlet of flow-diverter module 32.

Brine tank 45, in turn, is preferably discrete from drawer housing 18, and is firmly attached directly to the bottom of drawer housing 18, preferably locally substantially vertically aligned to the basin-shaped bottom portion 42 and preferably by means of one or more anchoring screws and/or one or more releasable mechanical couplings. Preferably brine tank 45 is moreover adjacent to modular cartridge 47 and is preferably rigidly attached also to the same modular cartridge 47, preferably by means of one or more anchoring screws and/or one or more releasable mechanical couplings.

With reference to FIGS. 4, 6 and 7, preferably brine tank 45 furthermore directly communicates with the basin-shaped bottom portion 42 of drawer housing 18 via a vertical pipe-extension 48 that protrudes downwards from the bottom of drawer housing 18 and directly fits, preferably in a substantially airtight and/or watertight manner, into a complementary brine inlet opening 48*a* formed on top wall of the same brine tank 45 preferably with the interposition of a corresponding annular sealing gasket.

In addition to the above, brine tank 45 preferably directly communicates with the basin-shaped bottom portion 42 of drawer housing 18 also via a second vertical pipe-extension 49 that protrudes downwards from the bottom of drawer housing 18 and directly fits, preferably in a substantially airtight and/or watertight manner, into a complementary air vent opening 49*a* formed on top wall of brine tank 45, beside the brine inlet opening 48*a*, preferably with the interposition of a corresponding annular sealing gasket.

Moreover, with reference to FIG. 7, in the example shown vertical pipe-extension 49 preferably additionally protrudes upwards into drawer housing 18 within the perimeter of the basin-shaped bottom portion 42, so as to arrange its upper mouth at a given high from the basin-shaped bottom portion 42 and thus prevent the brine from normally freely falling into brine tank 45 via the same vertical pipe-extension 49.

As a result, the brine preferably falls into brine tank 45 solely via the vertical pipe-extension 48, and the vertical pipe-extension 49 allows free ventilation of brine tank 45 and moreover the selective overflow into brine tank 45 of the exceeding brine that may accidentally stagnate on the basin-shaped bottom portion 42 of drawer housing 18.

Figure 10:
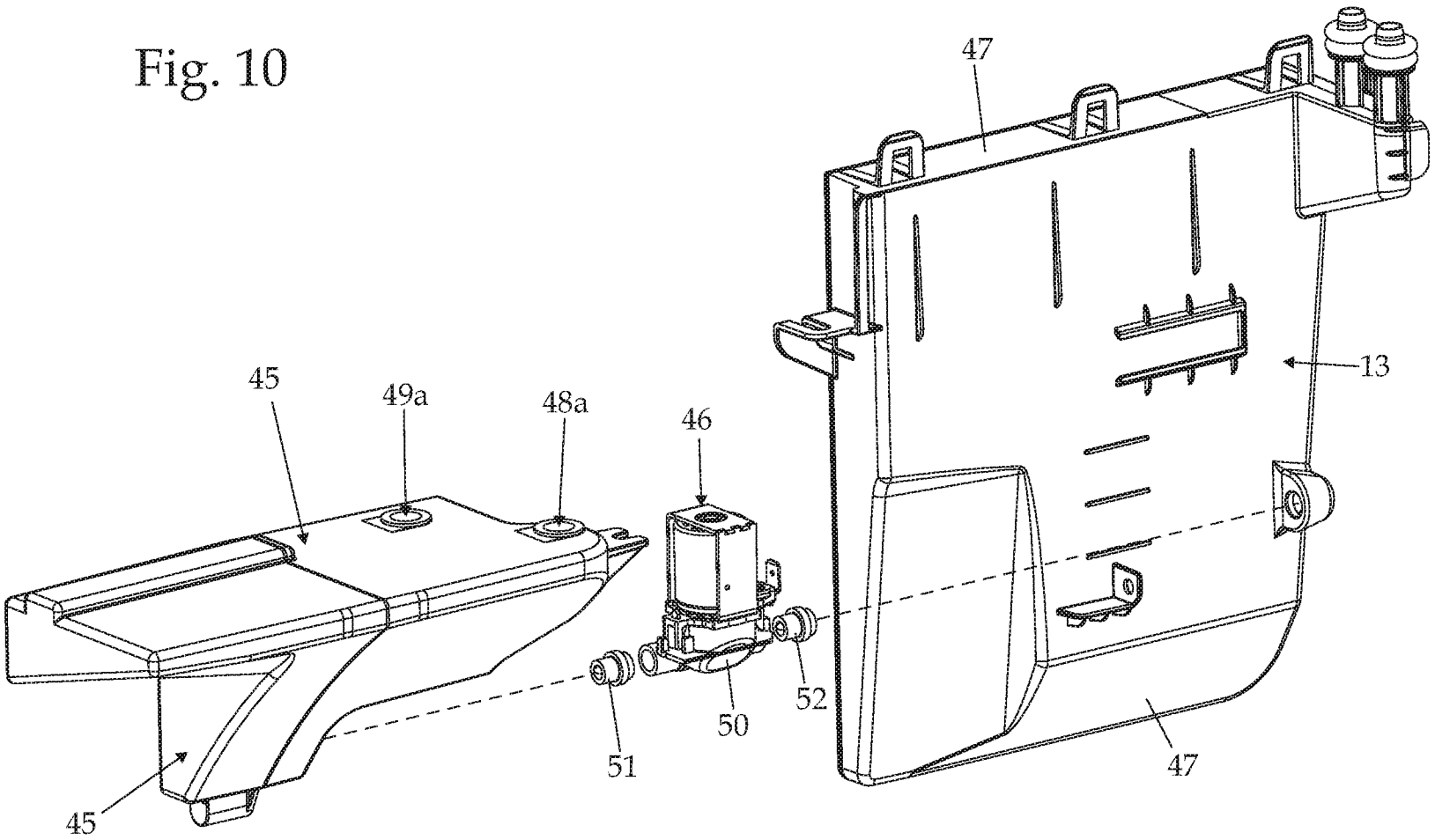
FIG. 10 is an enlarged and partially exploded perspective view of part of the to detergent dispensing assembly shown in FIGS. 4, 6 and 7, with parts removed for clarity.

With reference to FIGS. 4, 7 and 10, pump assembly 46, in turn, is preferably interposed between brine tank 45 and water softening device 13 so as to remain unmovably trapped between brine tank 45 and modular cartridge 47 when they are rigidly attached to one another.

Moreover pump assembly 46 preferably basically comprises an electrically-powered membrane pump 50 or other electrically-powered volumetric pump, which has the suction of the pump fluidically connected to brine tank 45 preferably via a first duckbill valve 51, so as to be able to suck the brine from the inside of brine tank 45, and the delivery of the pump fluidically connected to the modular cartridge 47 of water softening device 13 preferably via a second duckbill valve 52, so as to be able to feed the brine into the water softening device 13.

Figure 11:
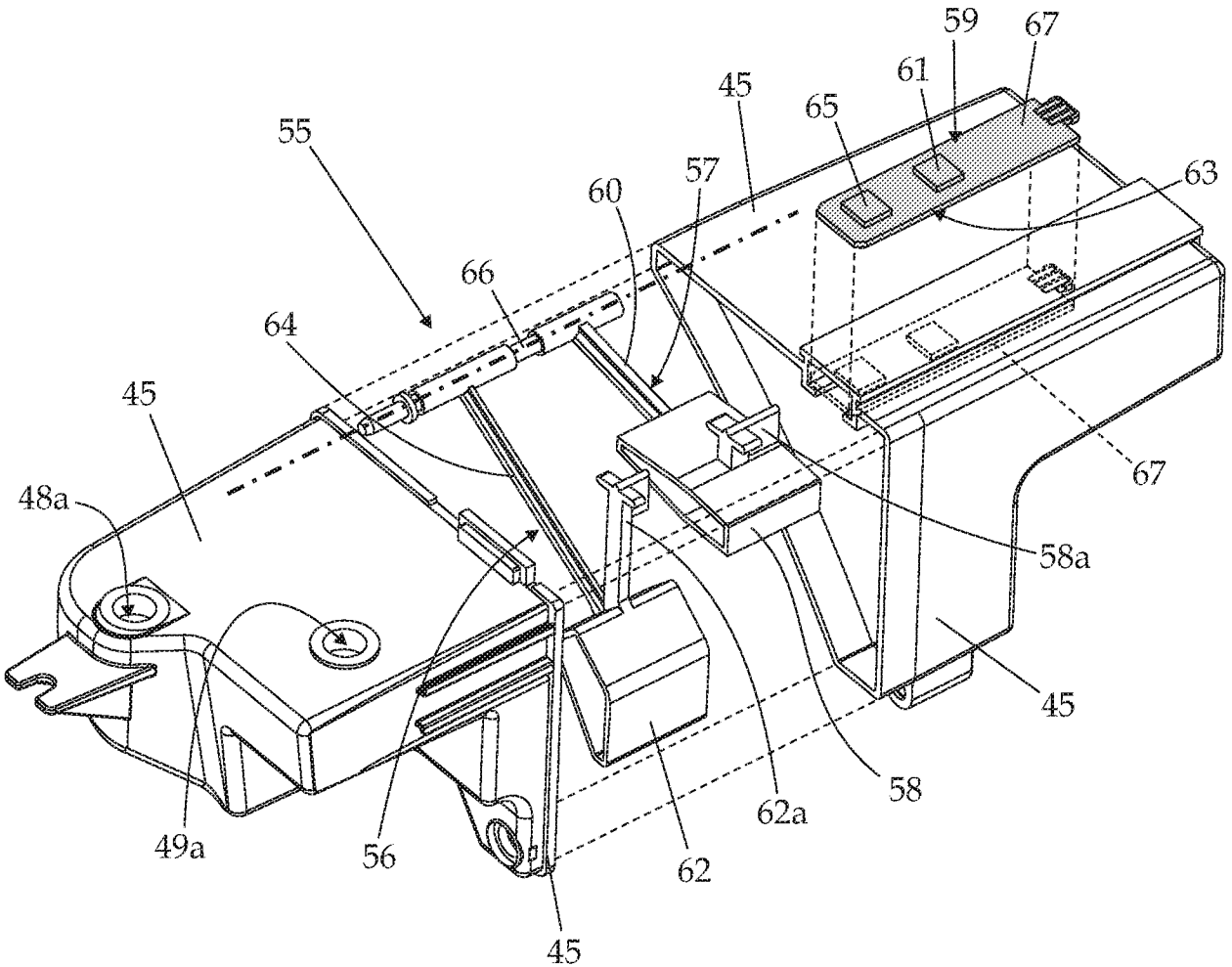
FIG. 11 is an enlarged and partially exploded perspective view of part of the detergent dispensing assembly shown in FIG. 10, with parts removed for clarity.

With reference to FIGS. 7 and 11, in addition to the above the laundry washing machine 1 furthermore comprises a detector assembly 55 which is associated to brine tank 45 and is capable of detecting when the salinity degree of the brine (i.e. salt water) stored into brine tank 45 exceeds a predetermined minimum salinity value, and optionally also of detecting when the level of the water or brine (i.e. salt water) stored inside brine tank 45 is equal to or higher than a predetermined threshold value $L_0$.

Preferably said predetermined minimum salinity value is moreover equal to or higher than the minimum salinity value required to successfully perform the regeneration process of the ion-exchange resins contained into the water softening device 13.

The threshold value $L_0$, in turn, preferably corresponds to a brine tank 45 completely filled up with fresh water or brine (i.e. salt water), i.e. to an amount of brine inside brine tank 45 sufficient to successfully perform the regeneration process of the ion-exchange resins contained into the water softening device 13.

More in detail, assuming that brine tank 45 is preferably dimensioned to contain a maximum amount of brine preferably equal to 270 $cm^3$ (cubic centimeters), the threshold value $L_0$ preferably corresponds to 270 $cm^3$ (cubic centimeters) of fresh water or brine into brine tank 45.

As an alternative, the threshold value $L_0$ could correspond to a brine tank 45 filled up with an amount of fresh water or brine (i.e. salt water) significantly lower than the maximum capacity of brine tank 45, and preferably solely sufficient to avoid cavitation or other malfunctioning of pump assembly 46.

More in detail, assuming that brine tank 45 is preferably dimensioned to contain a maximum amount of brine preferably equal to 270 $cm^3$ (cubic centimeters), the threshold value $L_0$ could correspond to only 20 $cm^3$ (cubic centimeters) of fresh water or brine into brine tank 45.

In the example shown, in particular, detector assembly 55 is preferably at least partially accommodated inside brine tank 45, and is preferably structured for detecting, at same time, whether the salinity degree of the brine (i.e. salt water) stored into brine tank 45 exceeds said minimum salinity value, and whether the level of the fresh water or brine (i.e. salt water) stored inside brine tank 45 is equal to or higher than said predetermined threshold value $L_0$.

More in detail, detector assembly 55 is preferably structured for detecting, at same time, whether the salinity degree of the brine (i.e. salt water) stored into brine tank 45 exceeds the minimum salinity value required to successfully perform the regeneration process of the ion-exchange resins contained into the water softening device 13, and whether the current level of the fresh water or brine (i.e. salt water) stored inside brine tank 45 is sufficient to successfully perform, in case of the brine, the regeneration process of the ion-exchange resins contained into the water softening device 13.

In other words, detector assembly 55 is preferably structured for detecting whether brine tank 45 is completely filled up with fresh water or brine (i.e. salt water).

With reference to FIG. 11, in particular, detector assembly 55 preferably comprises a salinity detector device 56 which is structured to detect when the salinity degree of the brine inside brine tank 45 is equal to or exceeds said minimum salinity value, and optionally also a water-level detector device 57 which is structured to detect when the level of the water or brine inside brine tank 45 is equal to or exceeds the threshold value $L_0$.

With reference to FIGS. 7 and 11, in the example shown, in particular, the water-level detector device 57 preferably comprises: a first floating body 58 which has a nominal density lower than that of the fresh water (i.e. lower than roughly 1000 $kg/m^3$), so as to float in presence of any kind of water (i.e. both fresh water and brine), and is housed inside brine tank 45 with the capability to freely move upwards and downwards according to the current level of fresh water or brine inside brine tank 45; and a corresponding electronic control unit 59 which is capable of monitoring the position of floating body 58 inside brine tank 45.

Preferably floating body 58 is moreover housed inside brine tank 45 with the capability to freely move upwards and downwards between a lowered position and a raised position according to the current level of fresh water or brine inside brine tank 45, and electronic control unit 59 is preferably capable of detecting when floating body 58 reaches said specific raised position inside the brine reservoir 45.

The raised position of floating body 58 corresponds to a level of fresh water or brine (i.e. salt water) inside brine tank 45 equal to or exceeding said threshold value $L_0$. The lowered position of floating body 58, in turn, preferably corresponds to roughly no fresh water or brine (i.e. salt water) inside brine tank 45.

In the example shown, in particular, floating body 58 is preferably rigidly attach to the distal end of a guide arm 60 which is pivotally jointed to brine tank 45 so as to be able to freely swing up and down inside brine tank 45 while remaining on a vertical reference plane.

The electronic control unit 59, in turn, preferably comprises a presence sensor 61 which is capable of detecting when the floating body 58 is in said specific raised position corresponding to an actual level of the fresh water or brine inside brine tank 45 equal to or exceeding the threshold value $L_0$.

More in detail, the electronic control unit 59 is preferably located on top of brine tank 45, vertically aligned to the floating body 58, and preferably comprises a presence sensor 61 which is capable of detecting when the floating body 58 substantially abuts against the top wall of brine tank 45.

In the example shown, in particular, the electronic control unit 59 is preferably accommodated on a hollow seat formed on top wall of brine tank 45, preferably vertically aligned to floating body 58, and the presence sensor 61 preferably comprises a mechanical transducer, namely a microswitch, capable of signalling when floating body 58 abuts against the same mechanical transducer 61.

Still with reference to FIGS. 7 and 11, the salinity detector device 56, in turn, preferably comprises: a second floating body 62 which has a nominal density higher than that of the fresh water, and is housed inside the brine reservoir 45 with the capability to move upwards and downwards; and a corresponding electronic control unit 63 capable of monitoring the position of floating body 62.

More in detail, the floating body 62 preferably has a nominal density higher than that of the fresh water and underapproximating, i.e. slightly lower than, the density of the brine having a salinity degree equal to said minimum salinity value (i.e. a brine capable of successfully performing the regeneration process of the ion-exchange resins of the water softening device 13), so as to float only in presence of selected brines having a salinity degree equal or higher that said minimum salinity value.

Preferably the floating body 62 is moreover housed inside brine tank 45 with the capability to freely move upwards and downwards between a lowered position and a raised position according to the current level of said selected brines inside brine tank 45, and the electronic control unit 63 is preferably capable of detecting when floating body 62 reaches said specific raised position inside brine reservoir 45.

The raised position of floating body 62 corresponds to a level of a selected brine (i.e. a brine having a salinity degree equal to or exceeding said minimum salinity value) inside brine tank 45 equal to or exceeding a predetermined second threshold value preferably lower than the threshold value $L_0$. The lowered position of floating body 62, in turn, preferably corresponds to roughly no selected brine (i.e. a brine having a salinity degree equal to or exceeding said minimum salinity value) inside brine tank 45.

More in detail, in the example shown floating body 62 has a nominal density preferably ranging between 1100 kg/m$^3$ and 1140 kg/m$^3$, so as to float only in presence of selected brines having a salinity degree preferably higher than 10% (i.e. preferably having more that 10 grams of dissolved salts per litre of water).

The second threshold value, in turn, corresponds for example to 70 cm$^3$ (cubic centimeters) of brine into brine tank 45.

With reference to FIGS. 7 and 11, similarly to floating body 58, in the example shown also floating body 62 is preferably rigidly attach to the distal end of a guide arm 64 which is pivotally jointed to brine tank 45 so as to be able to freely swing up and down inside brine tank 45 while remaining on a vertical reference plane.

The electronic control unit 63, in turn, preferably comprises a presence sensor 65 which is capable of detecting when the floating body 62 is arranged in said specific raised position corresponding to an actual level of the selected brine (i.e. a brine with a salinity degree equal to or exceeding said minimum salinity value) equal to or exceeding said second threshold value.

More in detail, the electronic control unit 63 is preferably located on top of brine tank 45, vertically aligned to the floating body 62, and preferably comprises a presence sensor 65 which is capable of detecting when the floating body 62 substantially abuts against the top wall of brine tank 45.

In the example shown, in particular, the electronic control unit 63 is preferably accommodated on a hollow seat formed on top wall of brine tank 45, preferably vertically aligned to floating body 62, and the presence sensor preferably comprises a mechanical transducer 65, namely a microswitch, capable of signalling when floating body 62 abuts against the same mechanical transducer 65.

With reference to FIGS. 7 and 11, in particular, the floating bodies 58 and 62 are preferably pivotally jointed to the body of brine tank 45 so as to be able to freely independently swing inside brine tank 45 one side by side the other.

More in detail, with particular reference to FIG. 11, both guide arms 60 and 64 are fitted in axially rotatable manner on a common supporting pin or shaft 66 extending inside brine tank 45 substantially horizontally and very close and parallel to a sidewall of brine tank 45.

The electronic control units 59 and 63, in turn, are preferably incorporated on a single control board 67 preferably accommodated on a corresponding hollow seat formed on top wall of brine tank 45, preferably vertically aligned to floating bodies 58 and 62.

Furthermore, each floating body 58, 62 is preferably provided with an upwards-protruding appendage 58*a*, 62*a* that cantilevered extends substantially vertically towards the top wall of brine tank 45, and is dimensioned to abut on the control board 67, against the corresponding mechanical transducer 61, 65, when the floating body 58, 62 reaches the corresponding raised position.

With reference to FIG. 5, the laundry washing machine 1 is preferably furthermore provided with an auxiliary fresh-water supply line 68 which is capable of selectively channelling the fresh water of the water mains directly into the brine tank 45 while bypassing the regeneration-agent compartment 21 of detergent drawer 16, i.e. the regeneration-agent reservoir, so that the non-salted fresh water can rinse the inside of brine tank 45.

In the example shown, in particular, the auxiliary fresh-water supply line 68 is preferably incorporated into the drawer flush circuit 19 of detergent dispenser 10.

The drawer flush circuit 19 is therefore preferably structured to selectively channel the fresh water arriving from fresh-water supply circuit 12 into anyone of the detergent compartments 17, into the regeneration-agent compartment 21, and additionally also into the basin-shaped bottom portion 42 of drawer housing 18 while bypassing regeneration-agent compartment 21, or directly into brine tank 45.

More in detail, with reference to FIG. 9, the plate-like water conveyor 31 is preferably provided, on the side directly faced to the inside of drawer housing 18, with a fourth water-delivery portion 69 which is vertically aligned to the bottom portion 42 of drawer housing 18 and vertically misaligned to the detergent drawer 16 arranged in retracted position, and is structured to allow the outflow of the fresh water from the plate-like water conveyor 31 towards the basin-shaped bottom portion 42 without affecting the regeneration-agent compartment 21.

In the example shown, in particular, the vertical pipe-extension 48 preferably branches off from the basin-shaped bottom portion 42 of drawer housing 18 at region of the basin-shaped bottom portion 32 vertically misaligned, when detergent drawer 16 is placed in the retracted position, to the drawer main body 23 of detergent drawer 16. The water-delivery portion 69 of plate-like water conveyor 31, in turn, is preferably arranged beside the water-delivery portions 33, 34 and 35, locally substantially vertically aligned to the vertical pipe-extension 48 protruding downwards from the bottom of drawer housing 18, and is preferably structured to project a jet of water into the upper mouth of the vertical pipe-extension 48 directly communicating with the inside of brine tank 45, thus to form an air-break.

In other words, in the example shown the drawer flush circuit 19 of detergent dispenser 10 is preferably structured to selectively direct a jet of fresh water of the water mains directly into the upper mouth of the vertical pipe-extension 48, thus to pour the fresh water directly into brine tank 45.

The electrically-operated, flow-diverter module 32, in turn, is preferably structured to selectively channel the water arriving to the water inlet of the same flow-diverter module 32 also towards the water-delivery portion 69 via a further internal water channel extending inside the body of plate-like water conveyor 31, from coupling socket 36 to water-delivery portion 69.

With particular reference to FIGS. 4, 5 and 6, the fresh-water supply circuit 12 of laundry washing machine 1, in turn, preferably comprises: a first water delivery line which is structured to channel the unsoftened fresh water of the water mains towards the water inlet of water softening device 13 preferably via the plate-like water conveyor 31 which, in turn, preferably furthermore channels the softened fresh water coming out from the water softening device 13 directly to the water inlet of water distributor 32; and optionally also a second water delivery line which is structured to channel the unsoftened fresh water of the water mains directly to the water inlet of water distributor 32 bypassing the water softening device 13.

More in detail, the first water delivery line of fresh-water supply circuit 12 preferably basically comprises a first electrically-operated on-off valve 70 which is connectable to the water mains, and a first connecting tube 71 or other piping which fluidically connects the on-off valve 70 to a corresponding auxiliary pipe-fitting 72 of plate-like water conveyor 31.

The auxiliary pipe-fitting 72 of plate-like water conveyor 31, in turn, fluidically communicates with the water inlet of water softening device 13, or better with the water inlet of modular cartridge 47, whereas the water outlet of water softening device 13, or better the water outlet of modular cartridge 47, fluidically communicates with the water inlet of water distributor 32 via a further internal water channel extending inside the body of plate-like water conveyor 31 up to coupling socket 36.

The second water delivery line of fresh-water supply circuit 12, on the other hand, preferably basically comprises a second electrically-operated on-off valve 73 which is connectable to the water mains, and a second connecting tube 74 or other piping which fluidically connects the on-off valve 73 directly to the water inlet of water distributor 32.

In addition to the above, with reference to FIGS. 4, 6 and 9, in the example shown the fresh-water supply circuit 12 preferably additionally comprises a further independent electrically-operated, on-off valve 75 which is separately connectable to a source of hot water (namely the hot branch of the piping, fittings, and fixtures involved in the distribution and use of hot water in the domestic building), and is directly connected, via a third connecting tube 76 or other piping, to a second pipe-fitting 77 that protrudes from plate-like water conveyor 31 preferably next to pipe-fitting 73.

This second pipe-fitting 77 directly communicates, via a further internal water channel extending inside plate-like water conveyor 31 up to coupling socket 36, with the water inlet of flow-diverter module 32, thus to channel a flow of hot, unsoftened fresh water towards the water inlet of flow-diverter module 32.

As an alternative, pipe-fitting 77 of plate-like water conveyor 31 may directly communicate with the water inlet of the water softening device 13, or better with the water inlet of modular cartridge 37, thus to channel a flow of hot, unsoftened fresh water towards the water inlet of the water softening device 13.

With reference to FIGS. 2, 5 and 9, the drawer flush circuit 19 of detergent dispenser 10 is preferably finally structured to selectively channel any kind of water that enters into the same drawer flush circuit 19, to a water drain line 78 that braches off from the drawer flush circuit 19 and ends into the drain sump 79 of washing tub 3, or even directly into the suction of the electric pump that drains the waste water or washing liquor outside the laundry washing machine 1.

In the example shown, in particular, the water drain line 78 preferably comprises a tube 80 or other piping, that branches off from a funnel-shaped portion 81 of drawer casing 18 and fits directly into the drain sump 79 of washing tub 3.

With reference to FIG. 9, the plate-like water conveyor 31, in turn, is preferably provided, on the side directly faced to the inside of drawer housing 18, with a further water-delivery portion 82 which is substantially vertically aligned to the funnel-shaped portion 81 of drawer casing 18, and is structured to allow the outflow of any kind of water from the plate-like water conveyor 31 towards the funnel-shaped portion 81.

Alike the other water-delivery portions 33, 34, 35, 69 of water conveyor 42, the water-delivery portion 82 selectively receives, from the electrically-operated, flow-diverter module 32, any kind of water entering into the same flow-diverter module 32.

With reference to FIG. 5, the laundry washing machine 1 is preferably finally provided with a second water drain line 83 that braches off from brine tank 45 and ends into the drain sump 79 of washing tub 3, or even directly into the suction of the electric pump that drains the waste water or washing liquor outside the laundry washing machine 1.

In the example shown, in particular, the second water drain line 83 preferably comprises: a tube or other piping 84, that branches off from the bottom of brine tank 45 and fits directly into the drain sump 79 of washing tub 3; and an electrically-operated, on-off valve 85 which is arranged along tube 84 for controlling the outflow of the water or brine from brine tank 45 towards the drain sump 79.

General operation of the laundry washing machine 1 is similar to that of the front loading washing machine disclosed in European patent No. 2657387, the main exception being that the brine (i.e. salt water) accumulates into brine tank 45 before being supplied to the internal water softening device 13, i.e. to the modular cartridge 47, for performing the regeneration process of the ion-exchange resins.

The partitioning septum 25 with micro-perforated structure, moreover, causes an extremely slow outflow of the brine (i.e. salt water) from the regeneration-agent compartment 21 which increases the salinity degree of the brine arriving into brine tank 45. The auxiliary fresh-water supply line 68, in turn, allows to selectively rinse/wash up the brine tank 45 preferably at the end of the regeneration process of the ion-exchange resins contained into the water softening device 13.

The detector assembly 55, on the other hand, allows the main electronic central control unit (not shown) of the laundry washing machine 1 to determine whether the brine to be pumped into the water softening device 13 has a sufficient salinity degree to successfully perform the regeneration process of the ion-exchange resins contained into the water softening device 13, and furthermore a precise control of the amount of brine to be pumped into the water softening device 13.

The combination of electric signals arriving from the salinity detector device 56 and the water-level detector device 57, in fact, allows the main electronic central control unit (not shown) of laundry washing machine 1 to determine whether the brine contained into brine tank 45 has a salinity degree sufficient for successfully performing the regeneration process of the ion-exchange resins, and whether the amount of brine contained into brine tank 45 is sufficient for successfully performing the regeneration process of the ion-exchange resins.

In addition to the above, detector assembly 55 allows the main electronic central control unit (not shown) of laundry washing machine 1 to indirectly determine when the amount of salt grains (NaCl) stored into regeneration-agent compartment 21 is depleting, and optionally to accordingly decide to stop or skip the regeneration process of the ion-exchange resins. A low salinity degree of the brine contained in brine tank 45, in facts, principally means that the amount of salt grains (NaCl) stored into regeneration-agent compartment 21 is depleting.

Advantageously detector assembly 55 moreover allows the main electronic central control unit (not shown) of laundry washing machine 1 to indirectly determine when the salt grains in the regeneration-agent compartment 21 form a big and compact block of salt difficult to be dissolved by the fresh water poured into the regeneration-agent compartment 21, and optionally to accordingly decide to stop or skip the regeneration process of the ion-exchange resins. A low salinity degree of the brine contained in brine tank 45, in facts, may also mean that fresh water poured into the regeneration-agent compartment 21 is unable to successfully dissolve a sufficient amount of salt grains in the regeneration-agent compartment 21.

Detector assembly 55 therefore is much more efficient than a salt level sensor monitoring solely the regeneration-agent compartment 21.

In addition to the above, detector assembly 55 allows the main electronic central control unit (not shown) of the laundry washing machine 1 to timely alert the user that refilling of salt grains (NaCl) into regeneration-agent compartment 21 is requested. The main electronic central control unit (not shown), in fact, may activate a warning light 86 located on control panel 14, and/or an blinking icon or message on the display of control panel 14, and/or other warning devices such as for example a buzzer or a message to a smartphone or other portable electronic device of the user, when detector assembly 55 detects, either for the first time or after a given number of consecutive times, a low salinity degree conditions.

The advantages resulting from the presence of detector assembly 55 are remarkable.

Detector assembly 55 always ensures a complete regeneration of the ion-exchange resins which increases the efficiency of the laundry washing machine 1.

Experimental tests, in fact, revealed that a complete regeneration of the ion-exchange resins takes place only if the percentage of salt dissolved into the brine is higher than a given minimum value. Moreover the residence time of the brine inside the water softening device 13 for achieving a complete regeneration of the ion-exchange resins is inverse proportional to the salinity degree of the brine. In other words, a brine having a high salinity degree is capable of regenerating the ion-exchange resins in less time.

Furthermore detector assembly 55 allows a precise metering of the amount of water supplied into brine tank 45 and into water softening device 13, thus significantly reducing the overall water consumption of the laundry washing machine.

Last, but not least, detector assembly 55 allows to timely alert the user that refilling of salt grains (NaCl) into regeneration-agent compartment 21 is requested.

Clearly, changes may be made to the laundry washing machine 1 without, however, departing from the scope of the present invention.

Figure 12:
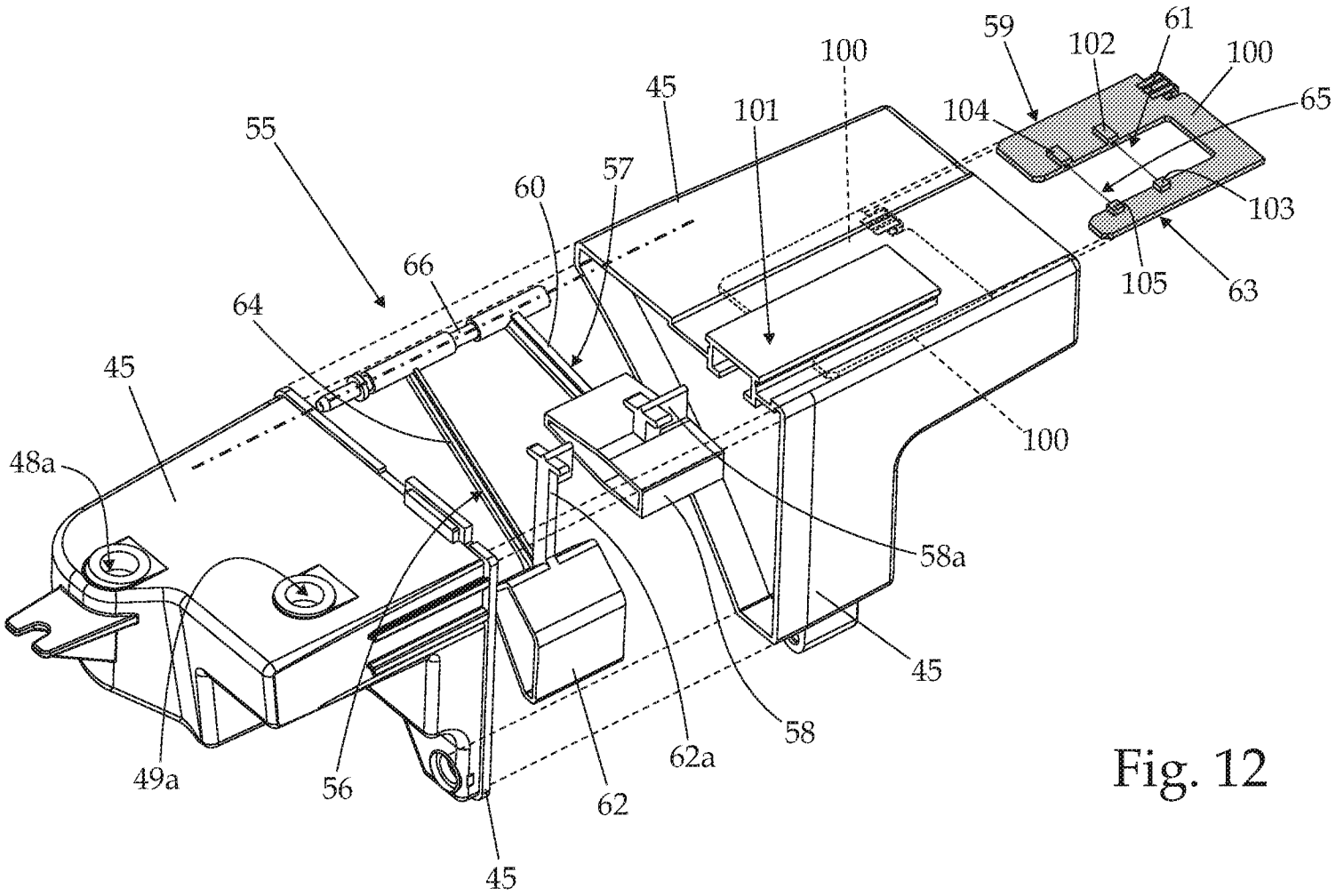

For example, with reference to FIG. 12, according to an alternative embodiment, the electronic control units 59 and 63 are arranged outside brine tank 45, preferably in abutment on top wall of the same brine tank 45 and preferably vertically aligned to floating bodies 58 and 62.

Preferably the presence sensor 61, 65 of each electronic control unit 59, 63 moreover comprises optical- or magnetic-type transducer/s which are capable of detecting when the corresponding floating body 58, 62, or better the distal ends of the upwards-protruding appendage 58*a*, 62*a* of the corresponding floating body, abuts against, or is very close to the top wall of brine tank 45.

More in detail, in the example shown the electronic control units 59 and 63 are preferably incorporated on a single preferably substantially U-shaped, control board 100 which is preferably fork fitted onto an upwards-extending protrusion 101 formed on top wall of brine tank 45.

The distal ends of the upwards-protruding appendages 58*a* and 62*a* of floating bodies 58 and 62, in turn, are preferably allowed to directly abut against the top wall of brine tank 45, inside the upwards-extending protrusion 101 on top wall of the same brine tank 45.

In the example shown, in particular, the presence sensor 61 of electronic control unit 59 preferably comprises a photo-emitter 102 and a photo-receiver 103 which are located on control board 100, aligned to one another on opposite sides of protrusion 101. The photo-emitter 102 generates a light beam that travels across protrusion 101 before reaching the photo-receiver 103, whereas the distal end of the upwards-protruding appendage 58*a* of floating body 58 is structured to interrupt the light beam directed to photo-receiver 103 preferably when abuts against the top wall of brine tank 45, inside the upwards-extending protrusion 101.

Similarly the presence sensor 65 of electronic control unit 53 preferably comprises a photo-emitter 104 and a photo-receiver 105 which are located on control board 100, aligned to one another on opposite sides of protrusion 101. The photo-emitter 104 generates a light beam that travels across protrusion 101 before reaching the photo-receiver 105, whereas the distal end of the upwards-protruding appendage 62*a* of floating body 62 is structured to interrupt the light beam directed to photo-receiver 104 preferably when abuts against the top wall of brine tank 45, inside the upwards-extending protrusion 101.

As an alternative, each floating body 58, 62 may have, incorporated on the distal end of the corresponding appendage 58*a*, 62*a*, an insert made of ferromagnetic material or permanent-magnetic material.

The presence sensor 61, 65 of the corresponding electronic control unit 53, 59, in turn, may comprise an magnetic transducer which is located on control board 100, close to protrusion 101, and is capable of switching according to the strength of the magnetic field in the proximity of the transducer. Magnetic field that significantly increases when the distal end of the appendage 58*a*, 62*a* abuts against or is very close to the top wall of brine tank 45, inside the upwards-extending protrusion 101.

Furthermore, according to a non-shown alternative embodiment, brine tank 45 may be incorporated into drawer housing 18.

In other words, the bottom portion 42 of drawer housing 18 may integrally have a big catchment sump wherein the brine accumulates, and the pump assembly 46 sucks the brine from the bottom of said catchment sump.

Preferably this catchment sump furthermore may be dimensioned to contain a given amount of brine which is preferably greater than 100 ml (millilitres), and which preferably also overapproximates the whole amount of brine to be pumped into the internal water softening device 13 for performing the regeneration process of the ion-exchange resins located inside the same water softening device 13.

Obviously detector assembly 55 is preferably at least partly accommodated inside the catchment sump formed on the bottom portion 42 of drawer housing 18 for detecting whether the salinity degree of the brine (i.e. salt water) stored into catchment sump exceeds a predetermined minimum salinity value, and optionally also for detecting whether the level of the water or brine (i.e. salt water)

accumulated into the same catchment sump is equal to or higher than said threshold value $L_0$.

Figure 13:
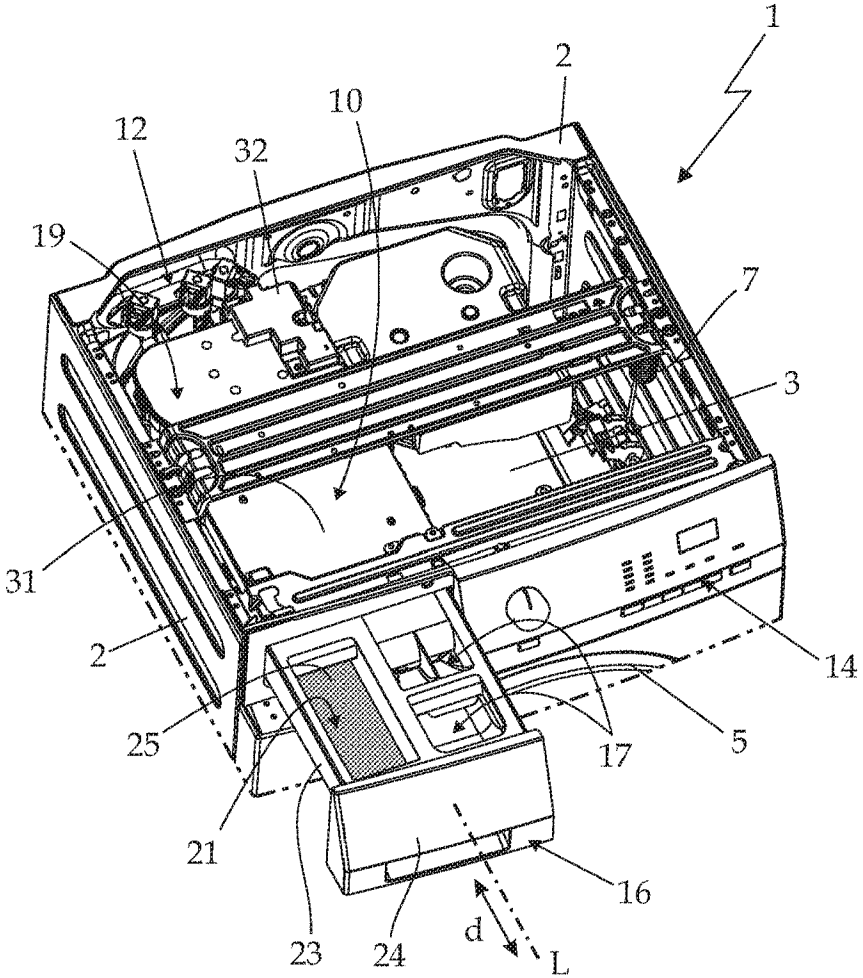

Moreover, with reference to FIG. 13, in a less-sophisticated embodiment the detergent drawer 16 lacks the manually openable, upper lid assembly 26, and the water-delivery portion 34 is arranged on the plate-like water conveyor 31 so as to be locally substantially vertically aligned, when detergent drawer 16 is placed in the retracted position, to the regeneration-agent compartment 21 of detergent drawer 16 and is structured to pour the fresh water directly into the beneath-located regeneration-agent compartment 21.

Preferably the water-delivery portion 34 of the plate-like water conveyor 31 is furthermore structured to pour by gravity a shower of water droplets directly into the beneath-located regeneration-agent compartment 21 of detergent drawer 16.

In other words, the drawer flush circuit 19 of detergent dispenser 10 is preferably capable of pouring by gravity a shower of water droplets selectively and alternatively into any one of the detergent compartments 17 and into the regeneration-agent compartment 21, and for additionally channelling the fresh water of the water mains directly to the brine tank 45 bypassing the regeneration-agent compartment 21 of detergent drawer 16.

Figure 14:
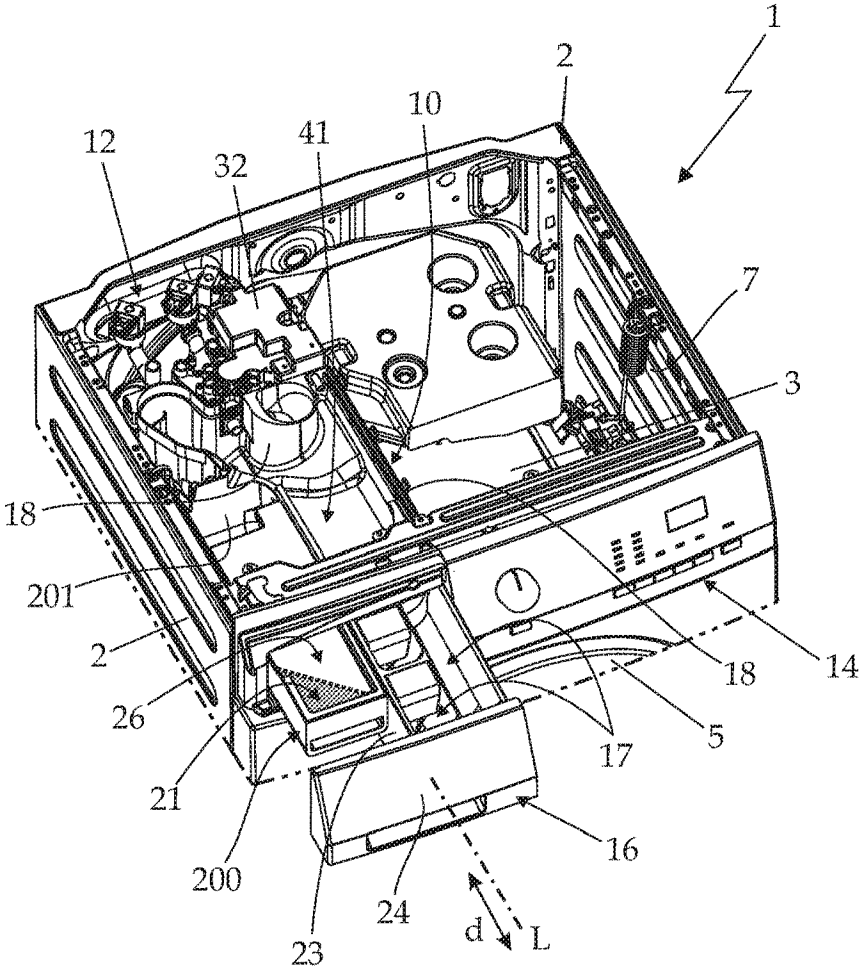
FIGS. 13 and 14 are perspective views of the top portion of two further embodiments of the FIG. 1 laundry washing machine shown, with parts removed for clarity.

With reference to FIG. 14, in a further alternative embodiment, the regeneration-agent compartment 21 is located/incorporated into a corresponding manually extractable, regeneration-agent drawer 200 which is discrete from detergent drawer 16, and is fitted/inserted in manually extractable manner into a corresponding substantially basin-shaped, drawer housing 201 which is preferably located/recessed inside casing 2 horizontally beside the detergent dispenser 10.

Drawer housing 201, in turn, has its own basin-shaped bottom portion which is structured for receiving the brine trickling/falling down from the regeneration-agent compartment 21 through the corresponding large pass-through draining opening 22, and directly communicates with the inside of a beneath-located brine tank 45 so as to allow the brine to quickly fall/flow by gravity directly into the brine tank 45 and to accumulate therein.

Brine tank 45, therefore, is located underneath the drawer housing 201 and is fluidically connected to said drawer housing 201 for catching and accumulating the brine trickling/falling down from the regeneration-agent compartment 21 through the pass-through opening 22.

Likewise the previous embodiments, brine tank 45 communicates with the inside of the water softening device 13 via the electrically-powered pump assembly 46 which is capable of selectively pumping the water or brine (i.e. salt water) accumulated into brine tank 45, from brine tank 45 to water softening device 13, and preferably also to watertight isolate the brine tank 45 from the water softening device 13 when deactivated.

Again the detector assembly 55 is preferably at least partly accommodated inside the brine tank 45 for detecting whether the salinity degree of the brine (i.e. salt water) stored into brine tank 45 exceeds a predetermined minimum salinity value, and optionally also for detecting whether the level of the water or brine (i.e. salt water) accumulated into the same brine tank 45 is equal to or higher than said predetermined threshold value $L_0$.

Preferably detergent drawer 16 and regeneration-agent drawer 200 are furthermore independently movable inside the respective drawer housings 18 and 201 parallel to and side by side to one another.

More in detail, alike detergent drawer 16, the regeneration-agent drawer 201 is movable in a substantially horizontally-oriented, displacement direction between:

- a retracted position in which regeneration-agent drawer 200 is almost completely recessed into the front wall 4 of casing 2 and the regeneration-agent compartment 21, or better the upper lid assembly 26, is inaccessible to the user; and
- a completely extracted position in which regeneration-agent drawer 200 partly juts out from the front wall 4 of casing 2, so that the regeneration-agent compartment 21 is exposed and fully accessible to the user prior opening of upper lid assembly 26.

With reference to FIG. 15, preferably drawer housing 201 is furthermore realized in one piece with drawer housing 18, and the plate-like water conveyor 41 of drawer flush circuit 19 is preferably structured to form the upper lid of both drawer housings 18 and 201.

Furthermore, even if regeneration-agent compartment 21 is no more formed/incorporated into the drawer main body 23 of detergent drawer 16, the manually-sizable front panel 24 of detergent drawer 16 is preferably still dimensioned to close, when detergent drawer 16 is placed in the retracted position, both the entrance of drawer housing 18 and the adjacent entrance of drawer housing 201. Thus the axial displacement of regeneration-agent drawer 200 towards the completely extracted position is exclusively allowable when also the detergent drawer 16 is placed in the extracted position.

In a further non-shown alternative embodiment, the drawer flush circuit 19 of detergent dispenser 10 is structured to solely channel the fresh water of the water mains into any one of the detergent compartments 17 of detergent drawer 16 and into the regeneration-agent compartment 21; and laundry washing machine 1 furthermore comprises an auxiliary fresh-water supply line which is directly connectable to the water to mains and/or is incorporated into the fresh-water supply circuit 12, and is structured for selectively channelling a flow of fresh water from the water mains directly into the brine tank 45 while bypassing the regeneration-agent compartment 21 of detergent drawer 16.

In this embodiment, therefore, the auxiliary fresh-water supply line is discrete from drawer flush circuit 19 and brine reservoir 45 receives the fresh water directly from the water mains, bypassing the drawer flush circuit 19.

More in detail, the auxiliary fresh-water supply line may comprise: a further independent electrically-operated, on-off valve which is separately connectable to the water mains; and a connecting tube or other piping which directly connects said electrically-operated, on-off valve directly to brine tank 45 thus to channel the fresh water of the water mains directly into brine tank 45.

In a less-sophisticated embodiment, furthermore, the drawer flush circuit 19 of detergent dispenser 10 may be structured to solely pour the fresh water of the water mains selectively and alternatively into any one of the detergent compartments 17 of detergent drawer 16. Laundry washing machine 1, in turn, may additionally comprise a second auxiliary fresh-water supply line which is directly connectable to the water mains and/or is incorporated into the fresh-water supply circuit 12, and is structured for selectively channelling a flow of fresh water from the water mains directly into the regeneration-agent compartment 21, or better into the upper lid assembly 26 located on top of regeneration-agent compartment 21.

Alike the first fresh-water supply line, also this second auxiliary fresh-water supply line is therefore discrete from drawer flush circuit 19.

More in detail, this second auxiliary fresh-water supply line may comprise a further independent electrically-operated, on-off valve which is separately connectable to the water mains; and a connecting tube or other piping which directly connects said further electrically-operated, on-off valve to an hydraulic connector which is stationary inside the drawer housing 18 and is structured to couple, when detergent drawer 16 or regeneration-agent drawer 85 is placed in the retracted position, in detachable manner with the water inlet 29 of the upper lid assembly 26, so as to put the upper lid assembly 26 in fluid communication with said tube.

In addition to the above, according to a further not-shown alternative embodiment, the detergent drawer 16 of detergent dispenser 10 may have, in place of the draining opening 22, a siphon assembly which is located inside the regeneration-agent compartment 21 and is suitably structured/dimensioned to selectively channel the brine formed inside the regeneration-agent compartment 21 onto the bottom of drawer housing 18.

According to a still further not-shown alternative embodiment, the one or more detergent compartments 17 of detergent drawer 16 may be dimensioned to contain a given amount of detergent, softener or other washing agent sufficient for performing a number of washing cycles. Furthermore, the detergent drawer 16 may optionally comprise, for each detergent compartment 17, a respective electrically-powered detergent feeding pump which is structured to selectively suck the dose of detergent, softener or other washing agent necessary to perform a washing cycle from the detergent compartment 17 and pump said dose of detergent, softener or other washing agent on the basin-shaped bottom portion 31 of drawer housing 18.

According to a still further not-shown, less-sophisticated alternative embodiment, the electrically-operated, flow-diverter module 32 of drawer flush circuit 19 may be incorporated into the plate-like water conveyor as disclosed in EP2562303.

Lastly, in a non-shown alternative embodiment of laundry washing machine 1, the laundry loading/unloading opening may be located on the upper worktop or top wall 11 of boxlike casing 2, and the washing tub 3 may be arranged inside casing 2 with the mouth directly facing the upper worktop or top wall 11. The rotatable drum, in turn, may be fitted vertically into washing tub 3 with the concavity facing the upper mouth of washing tub 3, so as to be able to rotate about a substantially vertically-oriented, longitudinal axis.

The invention claimed is:

1. A laundry washing machine comprising:

an outer casing;

a washing tub inside the outer casing;

a rotatable drum housed in an axially rotatable manner inside the washing tub and structured for housing laundry to be washed;

a detergent dispenser structured for supplying detergent into the washing tub;

a fresh-water supply circuit structured for selectively channeling a flow of fresh water from a water supply towards the detergent dispenser and/or the washing tub;

an internal water softening device filled with a water softening agent for reducing the hardness degree of the fresh water directed towards the detergent dispenser or the washing tub;

a regeneration-agent reservoir located inside the outer casing and structured for being manually fillable with a given amount of consumable salt or other regeneration agent;

a first water-supply line structured for selectively channeling a flow of fresh water into the regeneration-agent reservoir so as to form a brine;

a brine reservoir fluidly connected to the regeneration-agent reservoir for receiving and accumulating the brine arriving from the regeneration-agent reservoir; and a detector assembly associated with the brine reservoir and configured to detect when a salinity degree of the brine stored in the brine reservoir exceeds a predetermined minimum salinity value, and when a brine level in the brine reservoir reaches a predetermined level, wherein the detector assembly includes:

a salinity detector device that comprises:

a first floating body including a first body portion and a first protruding appendage having a first length that extends from the first body portion towards a top wall of the brine reservoir, the first floating body having a nominal density higher than that of the fresh water, and is housed inside the brine reservoir and configured to move upwards and downwards while maintaining the first protruding appendage extending from the first body portion towards the top wall of the brine reservoir; and a corresponding first electronic control unit located at the top wall of the brine reservoir configured to monitor the position of the first protruding appendage to detect when the salinity degree of the brine stored in the brine reservoir exceeds the predetermined minimum salinity value, and a water-level detector device that comprises:

a second floating body including a second body portion and a second protruding appendage having a second length that extends from the second body portion towards the top wall of the brine reservoir, the second floating body having a nominal density lower than that of the fresh water, and is housed inside the brine reservoir and configured to move upwards and downwards while maintaining the second protruding appendage extending from the second body portion towards the top wall of the brine reservoir; and a corresponding second electronic control unit located at the top wall of the brine reservoir configured to monitor the position of the second protruding appendage to detect when the brine level in the brine reservoir reaches the predetermined level, wherein:

1) the first length of the first protruding appendage is longer than the second length of the second protruding appendage, 2) the corresponding first electronic control unit and the corresponding second electronic control unit are mounted to a fork-shaped circuit board that physically engages with opposites sides of an upwards-extending protrusion formed on the top wall of the brine reservoir such that the upwards-extending protrusion is positioned in-between the fork-shaped circuit board, the corresponding first electronic control unit and the corresponding second electronic control unit monitor the first protruding appendage and the second protruding appendage through the upwards-extending protrusion, and 3) the second length of the second protruding appendage is maintained above the brine level, while a distance between the second protruding appendage and the second electronic control unit varies according to the brine level until the brine level reaches the predetermined level.

2. The laundry washing machine according to claim 1, wherein the predetermined minimum salinity value is a salinity value required to perform a regeneration process of the water softening agent contained in the water softening device.

3. The laundry washing machine according to claim 1, wherein the first floating body has a nominal density higher than that of the fresh water and lower than that of the brine having a salinity degree equal to the predetermined minimum salinity value, so as to float only when the brine has a salinity degree equal to or higher than the predetermined minimum salinity value.

4. The laundry washing machine according to claim 1, wherein the first electronic control unit is configured to detect when the first floating body reaches a raised position inside the brine reservoir.

5. The laundry washing machine according to claim 1, wherein the first floating body is attached to a distal end of a first guide arm which is pivotally jointed to the brine reservoir so as to be able to swing up and down inside the brine reservoir.

6. The laundry washing machine according to claim 1, wherein the first electronic control unit comprises a presence sensor which is configured to detect when the first floating body is in a raised position.

7. The laundry washing machine according to claim 1, wherein the first electronic control unit comprises a presence sensor which is configured to detect when the first floating body abuts against the top wall of the brine reservoir.

8. The laundry washing machine according to claim 1, further comprising a user warning means and a central control unit configured to activate the user warning means when the detector assembly detects a low salinity degree condition.

9. The laundry washing machine according to claim 1, wherein the second floating body is housed inside the brine reservoir and configured to move upwards and downwards between a respective lowered position and a respective raised position, and wherein the second electronic control unit is configured to detect when the second floating body reaches the respective raised position inside the brine reservoir, the respective raised position of the second floating body corresponding to a level of fresh water or brine inside the brine reservoir equal to or exceeding the predetermined level.

10. The laundry washing machine according to claim 1, wherein the second floating body is attached to a respective distal end of a second guide arm which is pivotally jointed to the brine reservoir so as to be able to swing up and down inside the brine reservoir.

11. The laundry washing machine according to claim 1, wherein the second electronic control unit comprises a presence sensor which is configured to detect when the second floating body is in the raised position.

12. The laundry washing machine according to claim 1, wherein the second electronic control unit comprises a presence sensor which is configured to detect when the second floating body abuts against a top wall of the brine reservoir.

13. The laundry washing machine according to claim 1, wherein the first floating body is attached to a distal end of a first guide arm which is pivotally jointed to the brine reservoir so as to be able to swing up and down inside the brine reservoir, wherein the second floating body is attached to a respective distal end of a second guide arm which is pivotally jointed to the brine reservoir so as to be able to swing up and down inside the brine reservoir, and wherein the first guide arm and second guide arm are fitted in an axially rotatable manner on a common supporting pin or shaft extending inside the brine reservoir.

14. The laundry washing machine according to claim 12, wherein the second floating body cooperates with the presence sensor.

15. The laundry washing machine according to claim 14, wherein the presence sensor of the second electronic control unit comprises an optical transducer, or a magnetic transducer.

16. The laundry washing machine according to claim 1, wherein the brine reservoir fluidly communicates with the water softening device via a pump assembly which is configured to selectively pump the brine accumulated into the brine reservoir, from the brine reservoir to the water softening device.

17. The laundry washing machine according to claim 1, further comprising a first drawer which is fitted in an extractable manner into a corresponding first drawer housing, and wherein the regeneration-agent reservoir is a basin-shaped, regeneration-agent compartment formed on the first drawer.

18. The laundry washing machine according to claim 17, wherein the brine reservoir is a discrete brine tank which is attached to a bottom of the first drawer housing, and communicates with the basin-shaped regeneration-agent compartment via a vertical pipe-extension that protrudes downwards from the bottom of the first drawer housing and fits into a complementary brine inlet opening formed on a top wall of the brine tank.

19. The laundry washing machine according to claim 17, wherein the first drawer is additionally provided with one or more detergent compartments which are arranged beside the regeneration-agent compartment and are each structured for being manually fillable with a given amount of detergent, softener or other washing agent.

20. The laundry washing machine according to claim 19, wherein the detergent dispenser furthermore comprises a drawer flush circuit which is connected to the fresh-water supply circuit, and is structured for selectively pouring the fresh water of the fresh-water supply circuit into any one of the detergent compartments to selectively flush the detergent, softener or other washing agent out of the same detergent compartment, and also into the regeneration-agent compartment to form the brine.

21. The laundry washing machine according to claim 17, wherein the regeneration-agent compartment is provided, on the bottom, with a brine outlet, and in that the first drawer additionally comprises a partitioning septum that covers the brine outlet and has a water-permeable structure designed to slow down the outflow of the brine from the regeneration-agent compartment via the brine outlet thus to cause a temporary stagnation of the water above the partitioning septum.

* * * * *